US011291279B2

(12) United States Patent
Liu

(10) Patent No.: US 11,291,279 B2
(45) Date of Patent: Apr. 5, 2022

(54) SUITCASE AND SUITCASE ASSEMBLY

(71) Applicant: FON DA TECH CO, LTD, Hsinchu (TW)

(72) Inventor: Yung-Ting Liu, Hsinchu County (TW)

(73) Assignee: FON DA TECH CO, LTD, Hsinchu County (TW)

( * ) Notice: Subject to any disclaimer, the term of this patent is extended or adjusted under 35 U.S.C. 154(b) by 345 days.

(21) Appl. No.: 16/370,581

(22) Filed: Mar. 29, 2019

(65) Prior Publication Data

US 2020/0297088 A1 Sep. 24, 2020

(30) Foreign Application Priority Data

Mar. 20, 2019 (EP) ..... 19164154

(51) Int. Cl.
*A45C 5/03* (2006.01)
*A45C 5/14* (2006.01)
*A45C 13/26* (2006.01)

(52) U.S. Cl.
CPC ..... *A45C 5/03* (2013.01); *A45C 5/14* (2013.01); *A45C 13/262* (2013.01)

(58) Field of Classification Search
CPC ..... A45C 5/03; A45C 5/143; A45C 13/262; A45C 2013/267; A45C 5/14; B65D 21/0217
USPC ..... 190/108; 206/509, 510; D9/554, 564; 446/75, 76
See application file for complete search history.

(56) References Cited

U.S. PATENT DOCUMENTS 3,005,282 A * 10/1961 Christiansen ..... A63H 33/086 446/128
4,422,212 A * 12/1983 Sheiman ..... A45C 5/143 16/29
4,963,115 A * 10/1990 Stowell Davin ..... A63H 17/262 280/103
5,035,324 A * 7/1991 Bertrand ..... B65D 81/365 206/457
5,099,968 A * 3/1992 Kikuchi ..... A45C 7/0045 190/108
5,131,882 A * 7/1992 Kiyokane ..... A63H 17/00 446/431
5,474,483 A * 12/1995 Sun ..... A63H 3/005 280/33.998

(Continued)

FOREIGN PATENT DOCUMENTS

CA 2227746 A1 * 8/1999 ..... A63H 33/04
CN 204147554 U 2/2015

*Primary Examiner* — Sue A Weaver

(57) ABSTRACT

The present invention relates to a suitcase, including a case body and a plurality of wheel assemblies. The case body has a cuboid shape and includes a front portion, a rear portion, a plurality of top cylindrical projections, at least one bottom tubular projection, and four sidewalls. The rear portion is connected to the front portion. The top cylindrical projections are on the rear portion and protrude outwardly. The bottom tubular projection is on the rear portion and protrudes outwardly in the opposite direction of the top cylindrical projections. The sidewalls surround the bottom tubular projection. There is a space between the bottom tubular projection and the sidewalls. The wheel assemblies are connected to the case body by closely engaged the wheel assemblies to the top cylindrical projections, or by closely engaged the wheel assemblies in the space.

15 Claims, 38 Drawing Sheets

(56) References Cited

U.S. PATENT DOCUMENTS

| | | | | |
|---|---|---|---|---|
| 2006/0272126 | A1* | 12/2006 | Burgess | A45C 13/262<br>16/113.1 |
| 2009/0218187 | A1* | 9/2009 | Chung | A45C 5/143<br>190/18 A |
| 2012/0228074 | A1* | 9/2012 | Osler | A45C 7/0045<br>190/18 A |
| 2015/0083632 | A1* | 3/2015 | Becklin | B65D 21/0202<br>206/509 |
| 2015/0245694 | A1* | 9/2015 | Banoun | A45C 5/145<br>190/18 A |

* cited by examiner

100A

100A

200A

200B

200C

200D

300A

300B

300C

1C

1F

SUITCASE AND SUITCASE ASSEMBLY

CROSS-REFERENCE TO RELATED APPLICATIONS

The present application claims priority to European Patent Application No. EP19164154.7, filed on Mar. 20, 2019, which is incorporated by reference herein in its entirety.

BACKGROUND OF THE INVENTION

Field of the Invention

The present invention relates to a suitcase and a suitcase assembly.

Description of the Related Art

Most suitcases on the commercial market today are generally made up of a case body, a draw bar, and a plurality of wheels fixed to the case body. However, this configuration is not convenient when a user needs to carry multiple suitcases at one time, such as when a parent is carrying his or her own suitcase and a suitcase belonging to his or her child at the same time. Furthermore, the conventional suitcases may slide toward any direction, making them hard to be stored.

BRIEF SUMMARY OF THE INVENTION

The present invention relates to a suitcase, including a case body and a plurality of wheel assemblies. The case body has a cuboid shape and includes a front portion, a rear portion connected to the front portion, a plurality of top cylindrical projections on the rear portion that protrude outwardly, at least one bottom tubular projection on the rear portion that protrudes outwardly in the opposite direction of the top cylindrical projections, and four sidewalls surrounding the bottom tubular projection. There is a space between the bottom tubular projection and the sidewalls. The wheel assemblies are connected to the case body by being closely engaged the wheel assemblies to the top cylindrical projections or being closely engaged the wheel assemblies in the space.

In some embodiments of the present invention, the case body further includes a plurality of side cylindrical projections formed on the front side surface of the front portion and the rear side surface of the rear portion, the top cylindrical projections are formed on the rear top surface of the rear portion, and the rear top surface faces a different direction than the front side surface and the rear side surface. The suitcase further includes a fixing member having a main body, at least one fixing tubular projection formed on the main body, and four fixing sidewalls surrounding the fixing tubular projection. At least one of the side cylindrical projections formed on the front portion and at least one of the side cylindrical projections formed on the rear portion are closely engaged with the fixing tubular projection and the fixing sidewalls.

In some embodiments of the present invention, each of the wheel assemblies includes a base, a wheel connected to one side of the base, and a wheel cylindrical projection formed on another side of the base. The wheel cylindrical projection is closely engaged with the bottom tubular projection and the sidewalls. In other embodiments of the present invention, each of the wheel assemblies includes a base, a wheel connected to one side of the base, and four wheel sidewalls formed on another side of the base. At least one of the top cylindrical projections is closely engaged with the wheel sidewalls.

In some embodiments of the present invention, the suitcase further includes a draw bar having a first end and a second end. The first end is connected to the case body, and the second end is opposite to the first end. The draw bar further includes a button positioned at the second end and having the same shape as one of the top cylindrical projections. The draw bar further includes a first portion directly connected to the case body and a second portion articulately connected to the first portion. The suitcase further includes a plurality of front cylindrical projections formed on the front portion, at least one rear tubular projection formed on the rear portion, and four rear sidewalls surrounding the rear tubular projection. Each of the front cylindrical projections has the same dimensions as each of the top cylindrical projections, and the rear tubular projection has the same dimensions as the bottom tubular projection.

The present invention further relates to a suitcase assembly, including at least two case bodies having a cuboid shape and connected with each other and a plurality of wheel assemblies connected to one of the case bodies. Each of the case bodies includes a front portion, a rear portion connected to the front portion, a plurality of top cylindrical projections on the rear portion that protrude outwardly, at least one bottom tubular projection on the rear portion that protrudes outwardly in the opposite direction of the top cylindrical projections, and four sidewalls surrounding the bottom tubular projection.

In some embodiments of the present invention, the top cylindrical projection formed on one of the case bodies is closely engaged with the bottom tubular projection and at least one of the sidewalls of another case body. Furthermore, the top cylindrical projection formed on one of the case bodies is closely engaged with a plurality of the bottom tubular projections of another case body.

The present invention further relates to a suitcase assembly, including at least two case bodies having a cuboid shape and connected with each other and a plurality of wheel assemblies connected to the case bodies. The front cylindrical projection of one of the case bodies is closely engaged with the rear tubular projection and the sidewalls of another case body. Each of the case body includes a front portion, a rear portion connected to the front portion, a plurality of front cylindrical projections formed on the front portion, at least one rear tubular projection formed on the rear portion, and four sidewalls surrounding the rear tubular projection. The rear tubular projection is opposite the front cylindrical projections.

In some embodiments of the present invention, the two case bodies have different dimensions. The suitcase assembly further includes a plurality of draw bars. Each of the draw bars has a first portion directly connected to one of the case bodies and a second portion articulately connected to the first portion.

BRIEF DESCRIPTION OF THE DRAWINGS

Aspects of this disclosure are best understood from the following detailed description when read with the accompanying figures. It should be noted that, in accordance with common practice in the industry, various features are not drawn to scale. In fact, the dimensions of the various features may be arbitrarily increased or reduced for clarity of discussion.

DETAILED DESCRIPTION OF THE INVENTION

Figure 1:
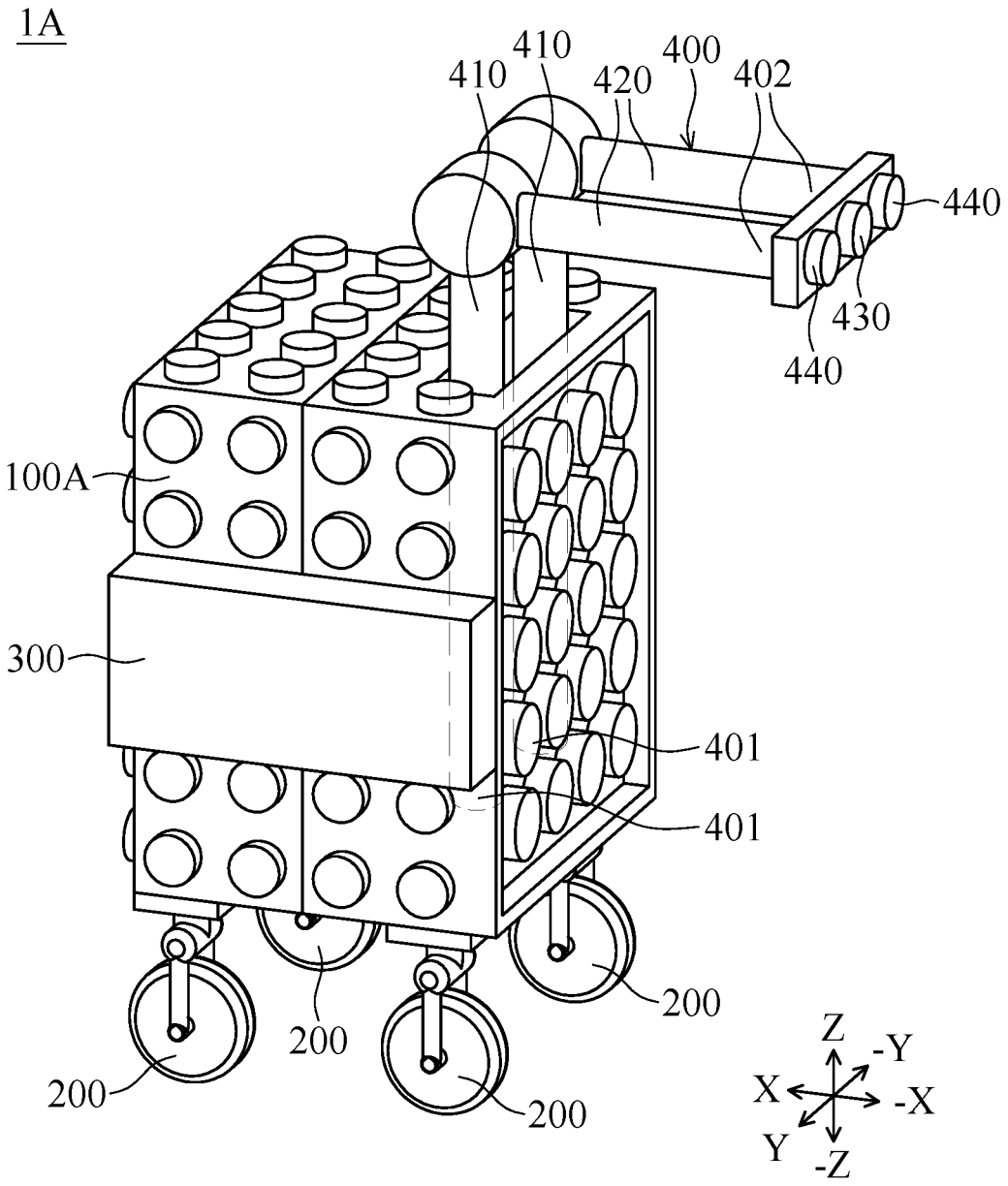
FIG. 1 is a schematic view of a suitcase in some embodiments of the present invention.

The following disclosure provides many different embodiments, or examples, for implementing different features of the subject matter provided. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features. In addition, the present disclosure may repeat reference numerals and/or letters in the various examples. This repetition is for the purpose of simplicity and clarity and does not in itself dictate a relationship between the various embodiments and/or configurations discussed.

Furthermore, spatially relative terms, such as "below," "lower," and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented and the spatially relative descriptors used herein may likewise be interpreted accordingly.

A suitcase 1A according to some embodiments of the present invention is shown in FIG. 1. The suitcase 1A includes a case body 100A, a plurality of wheel assemblies 200, a fixing member 300 and a draw bar 400. The case body 100A has a cuboid shape, the wheel assemblies 200 are attached on one surface of the case body 100A, and the fixing member 300 is attached to another surface of the case body 100A which is adjacent to the surface where the wheel assemblies 200 attached. In some embodiments, the wheel assemblies 200 and the fixing member 300 are attached to two surfaces that are perpendicular to each other. The draw bar 400 includes a first portion 410 and a second portion 420. The first portion 410 is articulately connected to the second portion 420, and has a first end 401 inserted in the case body 100A and directly connected to the case body 100. It should be noted that some part of the first portion 410 embedded in the case body 100A (e.g. the first end 401) is illustrated by dashed line. The second portion 420 has a second end 402 which is opposite the first end 401 of the first portion 410. Furthermore, the draw bar 400 also includes a button 430 and at least one draw bar projection 440 formed on the second end 402.

Figure 2A:
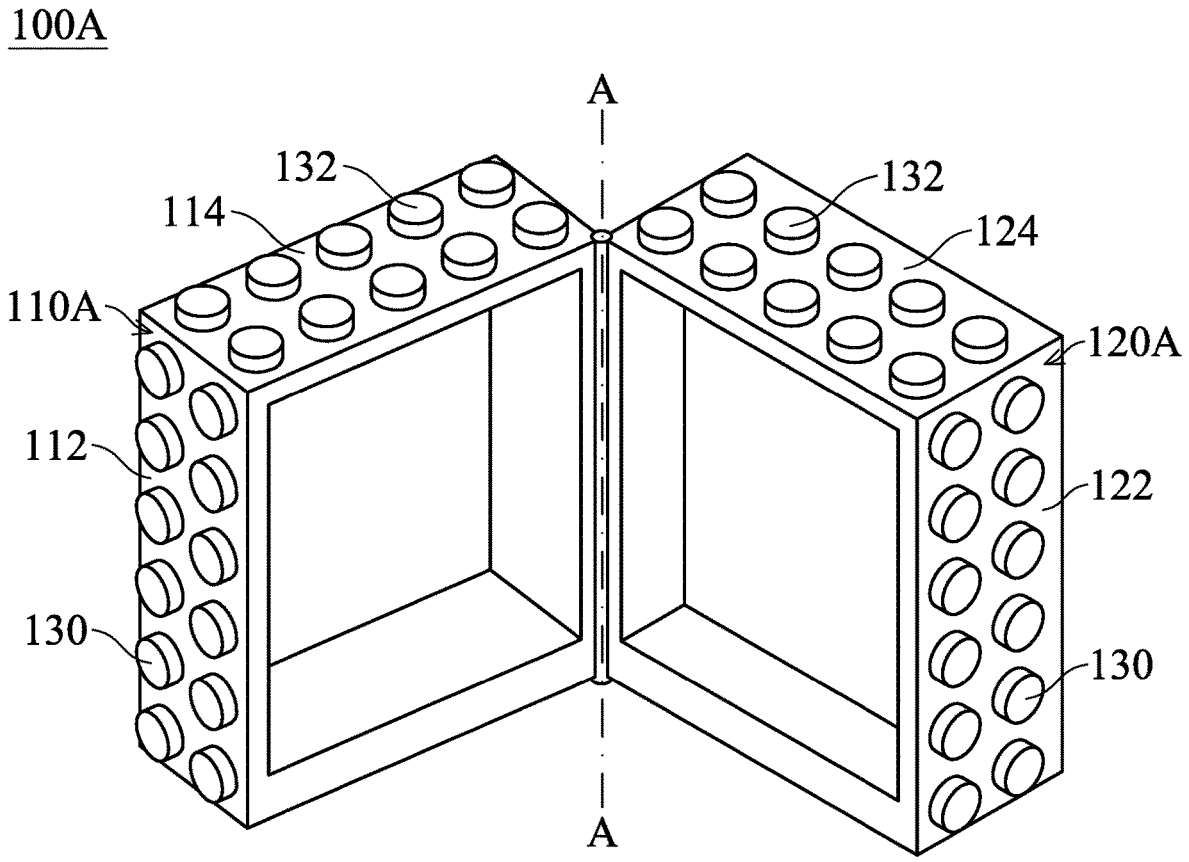
FIGS. 2A-2C are schematic views of a case body in some embodiments of the present invention.
Figure 2B:
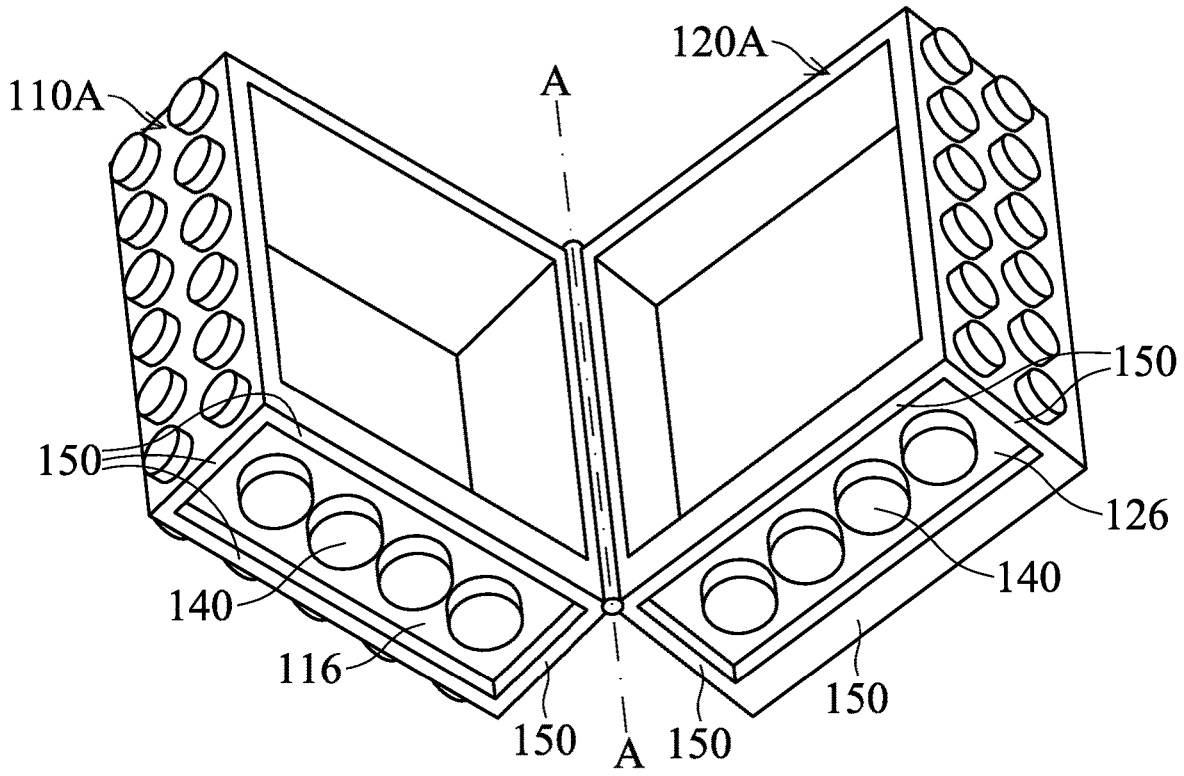
Figure 2C:
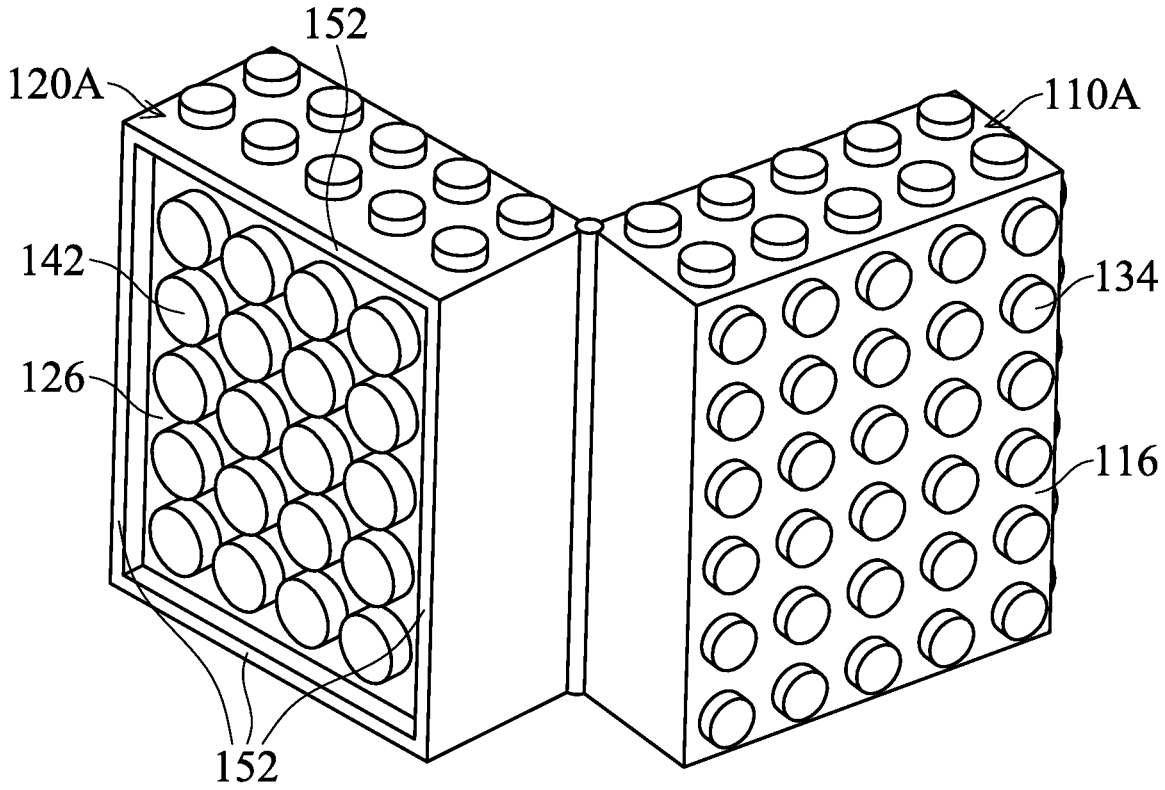

The case body 100A of the suitcase 1A is shown in FIGS. 2A-2C, which includes a front portion 110A and a rear portion 120A connected with each other and arranged in the X direction. For example, the front portion 110A and the rear portion 120A may be pivotally connected with each other (as shown by the axis A-A). However, the present invention is not limited thereto. Any suitable manner for connecting the front portion 110A and the rear portion 120A may be utilized to connect the front portion 110A and the rear portion 120A. A plurality of side cylindrical projections 130 are formed on the front side surface 112 of the front portion 110A and formed on the rear side surface 122 of the rear portion 120A, and a plurality of top cylindrical projections 132 are formed on the front top surface 114 of the front portion 110A and formed on the rear top surface 124 of the rear portion 120A. The top cylindrical projections 132 protrude outwardly in the Z direction, which is perpendicular to the X direction. It should be noted that the rear top surface 124 faces a different direction than the front side surface 112 and the rear side surface 122. In some embodiments, the rear top surface 124 may be orthogonal to the rear side surface 122. Furthermore, the button 430 (see FIG. 1) may have a same shape as each of the top cylindrical projections 132 for uniformity.

Furthermore, a plurality of bottom tubular projections 140 are formed on a front bottom surface 116 of the front portion 110A and formed on a rear bottom surface 126 of the rear portion 120A and protrude outwardly in the -Z direction, which is opposite to the Z direction, as shown in FIG. 2B. Each of the front bottom surface 116 and the rear bottom surface 126 includes four sidewalls 150 surrounding the bottom tubular projections 140. A plurality of front cylindrical projections 134 are formed on a front surface 116 of the front portion 110A and protrude outwardly in the X direction, and at least one rear tubular projections 142 is formed on a rear surface 126 of the rear portion 120A and extending in the -X direction opposite from the X direction, as shown in FIG. 2C. Four rear sidewalls 152 are formed on the rear surface 126 and surround the rear tubular projections 142. It should be noted that the sidewalls 150 or the rear sidewalls 152 may have different thicknesses for fulfilling various design requirements.

Figure 2D:
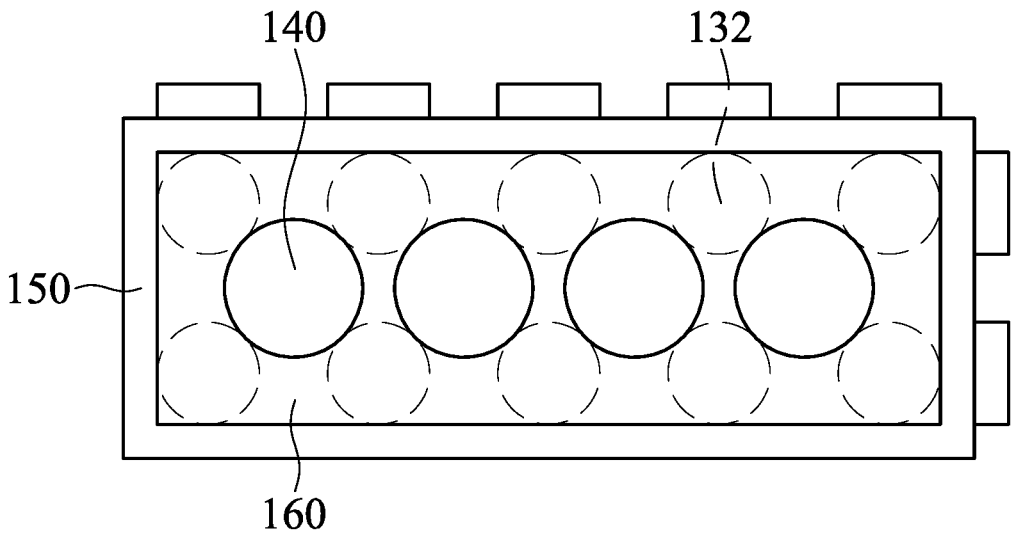
FIG. 2D is a schematic view of a relationship between the top cylindrical projections, the bottom tubular projections and the sidewalls of a suitcase in some embodiments of the present invention.

FIG. 2D shows a relationship between dimensions of the top cylindrical projections 132, the bottom tubular projections 140 and the sidewalls 150. In FIG. 2D, there is a space 160 between the bottom tubular projections 140 and the sidewalls 150. The dashed lines indicate the shapes of the top cylindrical projections 132. The top cylindrical projections 132 may be closely engaged into the space 160 if two case bodies 100A are assembled with each other. In other words, the minimum number of the bottom tubular projections 140 plus the sidewalls 150 that each of the top cylindrical projections 132 may directly contact is three. For example, each of the top cylindrical projections 132 may directly contact one tubular projection 140 and two sidewalls 150, or contacts two tubular projections 140 and one sidewall 150, as shown in FIG. 2D. As a result, each of the top cylindrical projections 132 may be inserted into the space 160.

In this configuration, the case bodies 100A may be assembled with each other in a manner similar to LEGO blocks. The same principle also applies to other cylindrical projections, such as the front cylindrical projections 134, other tubular projections and sidewalls, such as the rear tubular projections 142 and the rear sidewalls 152. In some embodiments, the cylindrical projection may directly contact four tubular projections at the same time for being closely engaged in the spaces formed between the four tubular projections.

Figure 2E:
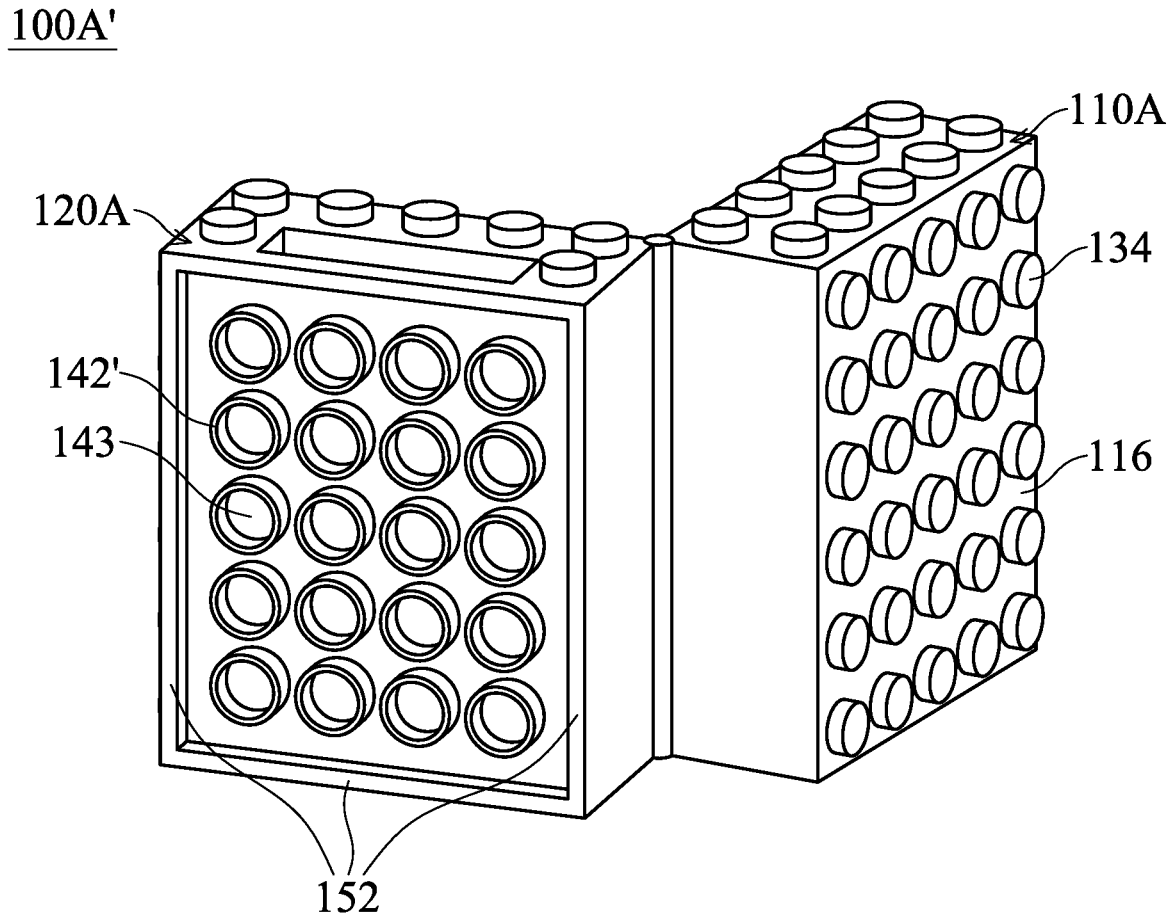
FIG. 2E is a schematic view of a case body in some embodiments of the present invention.

In some embodiments, the side cylindrical projections 130, the top cylindrical projections 132, and the front cylindrical projections 134 may have the same dimensions (e.g. diameter) to allow the case bodies 110A to be assembled with other elements (e.g. other suitcases) in various directions. In other embodiments, the side cylindrical projections 130, the top cylindrical projections 132, and the front cylindrical projections 134 may have a different dimension to restrict the manner of assembling. In some embodiments, the rear tubular projection 142 may have the same dimensions as the bottom tubular projection 140. In some embodiments, the bottom tubular projection 140 or the rear tubular projection 142 may have a hollow structure with a hole in the projections which has an inner diameter that is substantially identical to the diameter of the top cylindrical projections 132, or the front cylindrical projections 134 to allow the cylindrical projections to be inserted and closely engaged therein. For example, please see FIG. 2E, which is a schematic view of a case body 100A' in some embodiments of the present invention. The case body 100A' has rear tubular projections 142' with a hole 143 forms in each of the rear tubular projections 142'. The hole 143 has an inner diameter substantially equal to the outer diameter of the cylindrical projection (e.g. side cylindrical projections 130, top cylindrical projections 132, or the front cylindrical projections 134, etc.). In some embodiments, the bottom tubular projection 140 of the previous embodiments may be substituted by a structure similar to the rear tubular projections 142' as well.

Figure 3A:
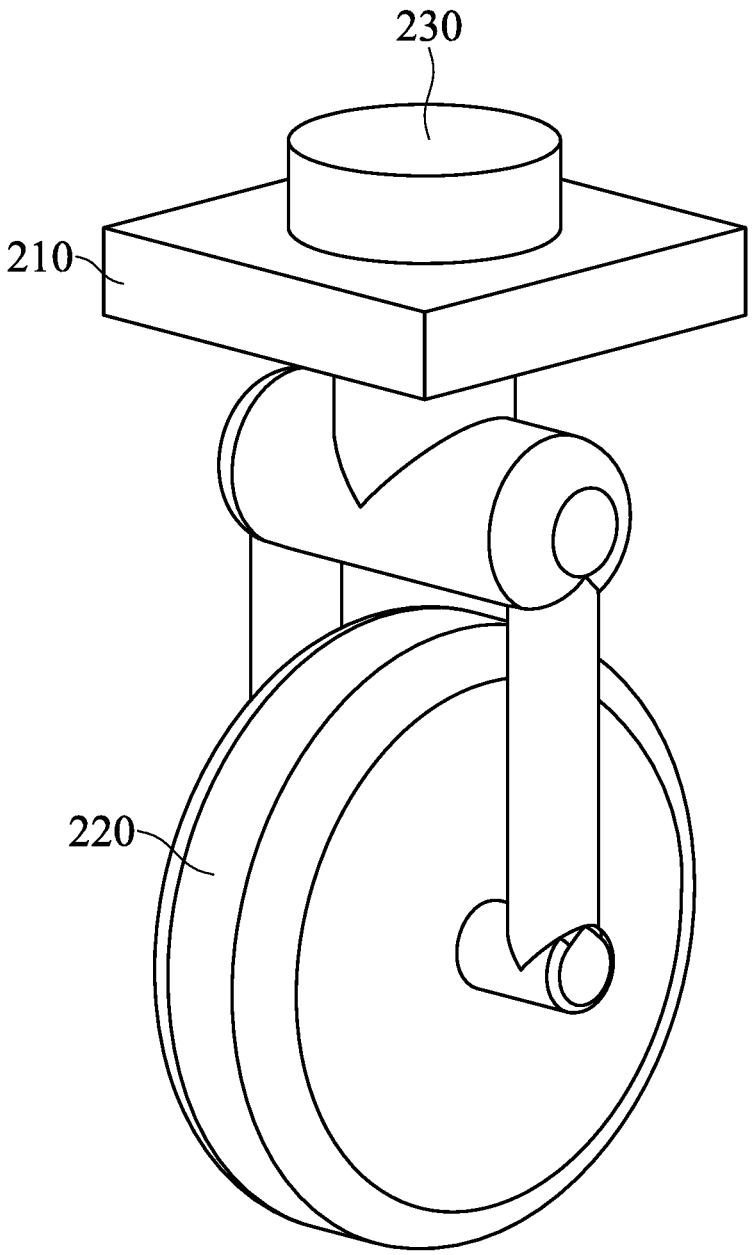
FIG. 3A is a schematic view of a wheel assembly in some embodiments of the present invention.
Figure 3B:
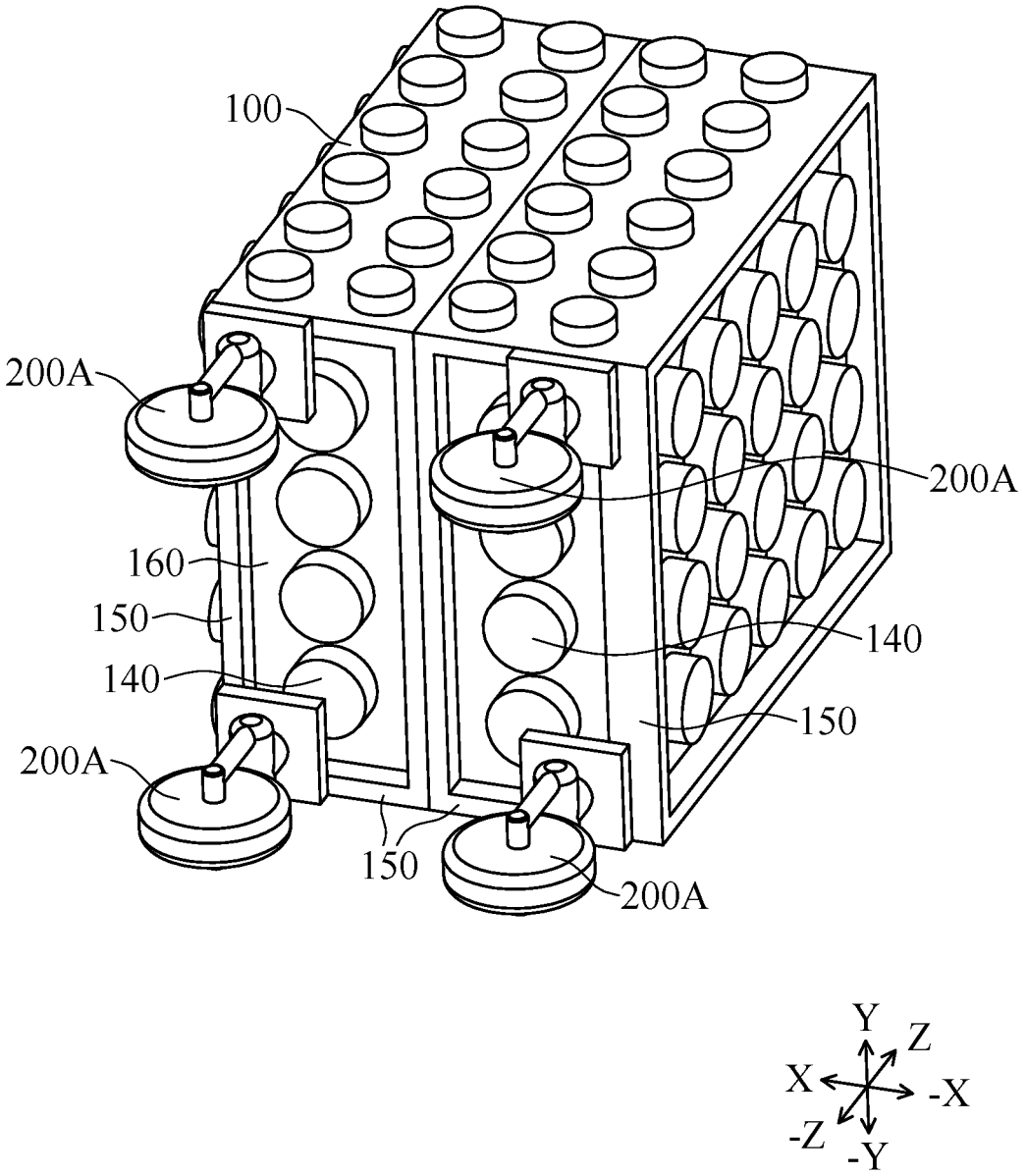
FIG. 3B is a schematic view of the wheel assemblies in FIG. 3A assembled with the case body.

FIG. 3A is a schematic view of a wheel assembly 200A in some embodiments of the present invention. In FIG. 3A, the wheel assembly 200A mainly includes a base 210, a wheel 220 connected to one side of the base 210, and a wheel cylindrical projection 230 protruding from another side of the base 210. As shown in FIG. 3B, which is a schematic view of the wheel assemblies 200A assembled with the case body 100, the wheel cylindrical projection 230 may have a dimension which may be closely engaged to the space 160. In other words, the wheel cylindrical projection 230 may be closely engaged with the bottom tubular projections 140 and the sidewalls 150. In some embodiments, the wheel cylindrical projection 230 may have the same dimensions (e.g. diameter) as one of other cylindrical projections (e.g. side cylindrical projection 130, top cylindrical projection 132, or the front cylindrical projection 134, etc.).

Figure 3C:
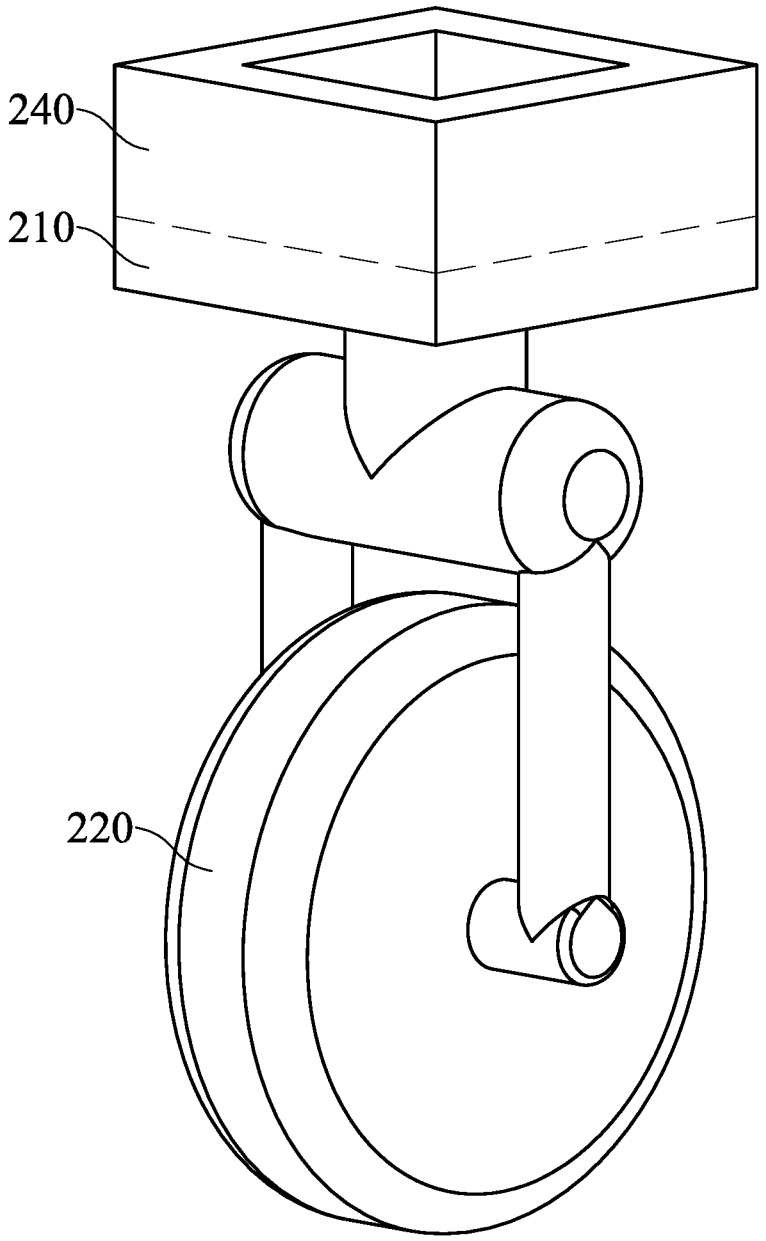
FIG. 3C is a schematic view of a wheel assembly in some embodiments of the present invention.
Figure 3D:
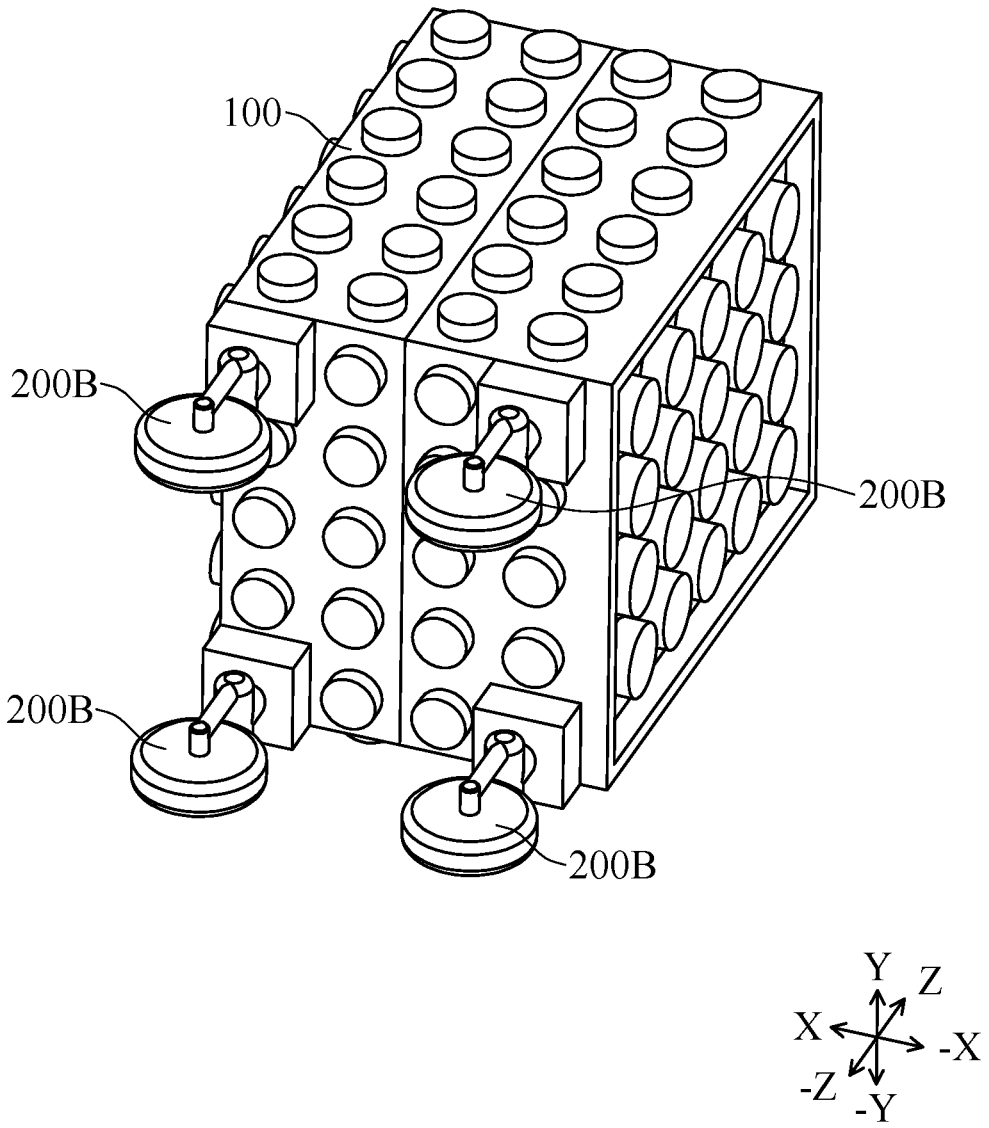
FIG. 3D is a schematic view of the wheel assemblies in FIG. 3C assembled with the case body.

FIG. 3C is a schematic view of a wheel assembly 200B in some embodiments of the present invention. In FIG. 3C, the wheel assembly 200B mainly includes a base 210, a wheel 220 connected to one side of the base 210, and four wheel sidewalls 240 formed on another side of the base 210. As shown in FIG. 3D, which is a schematic view of the wheel assemblies 200B assembled with the case body 100, the wheel sidewalls 240 may have a dimension that one of the top cylindrical projections 132 (not shown in FIG. 3D) may be engaged therein. In other words, the top cylindrical projection 132 may be closely engaged with the wheel sidewalls 240, or the wheel assembly 200B may be closely engaged to the top cylindrical projections 132. In some embodiments, the four wheel sidewalls 240 form a square, and the inner dimension (e.g. length) of the square is substantially identical to the diameter of other cylindrical projections (e.g. side cylindrical projection 130, top cylindrical projection 132, or the front cylindrical projection 134, etc.).

Figure 3E:
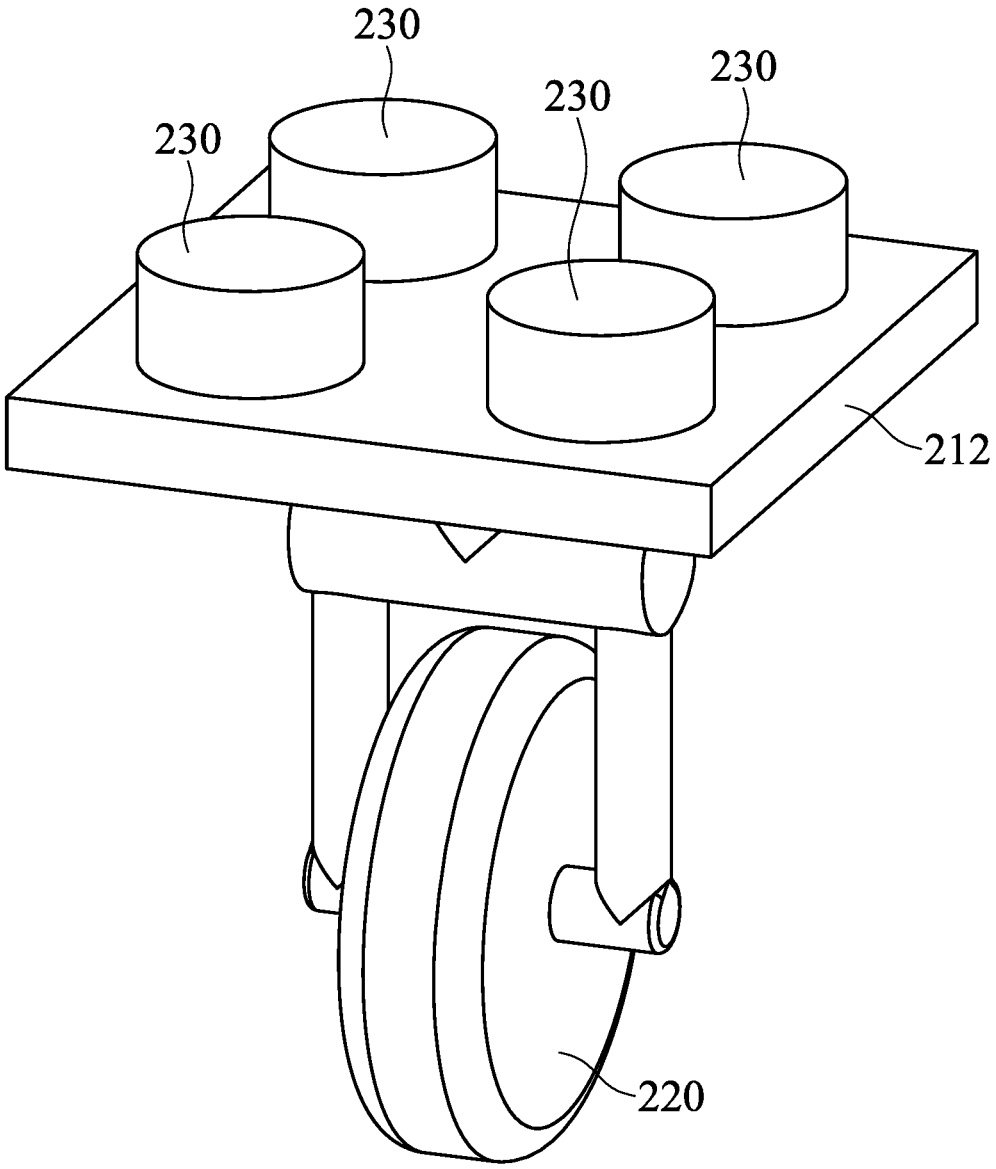
FIG. 3E is a schematic view of a wheel assembly in some embodiments of the present invention.
Figure 3F:
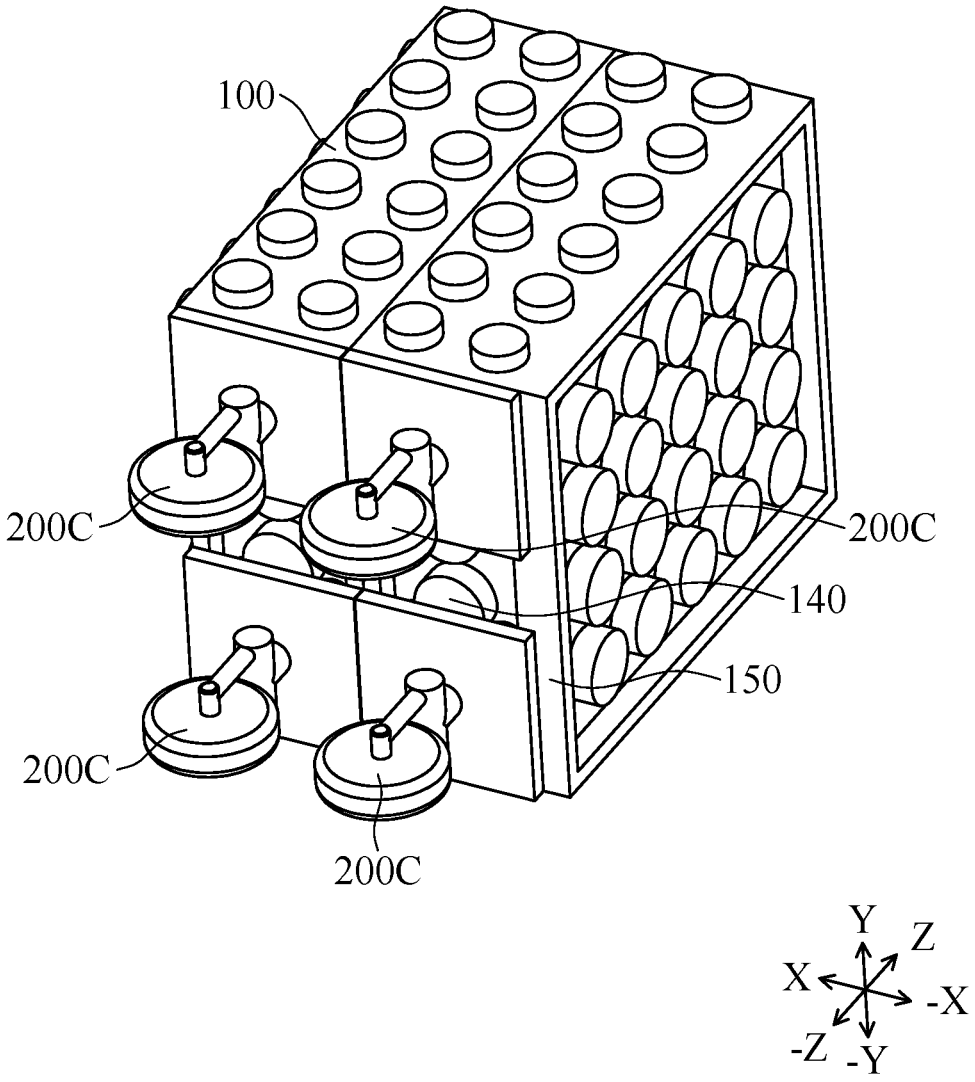
FIG. 3F is a schematic view of the wheel assemblies in FIG. 3E assembled with the case body.

Although in FIG. 3A, only one wheel cylindrical projection 230 is formed on the wheel assemblies 200A, the present invention is not limited thereto. For example, a schematic view of a wheel assembly 200C in some embodiments of the present invention is shown in FIG. 3E. In FIG. 3E, The wheel assembly 200C includes a base 212, a wheel 220 connected to one side of the base 212, and a plurality of wheel cylindrical projections 230 formed on another side of the base 212. The wheel cylindrical projections 230 are arranged in row and column to allow the wheel assembly 200C to be installed on the case body 100, as shown in FIG. 3F. In this embodiment, the amount of the wheel cylindrical projections 230 is four, but the present invention is not limited thereto. The amount of the wheel cylindrical projections 230 may be adjusted to meet different design requirements.

Figure 3G:
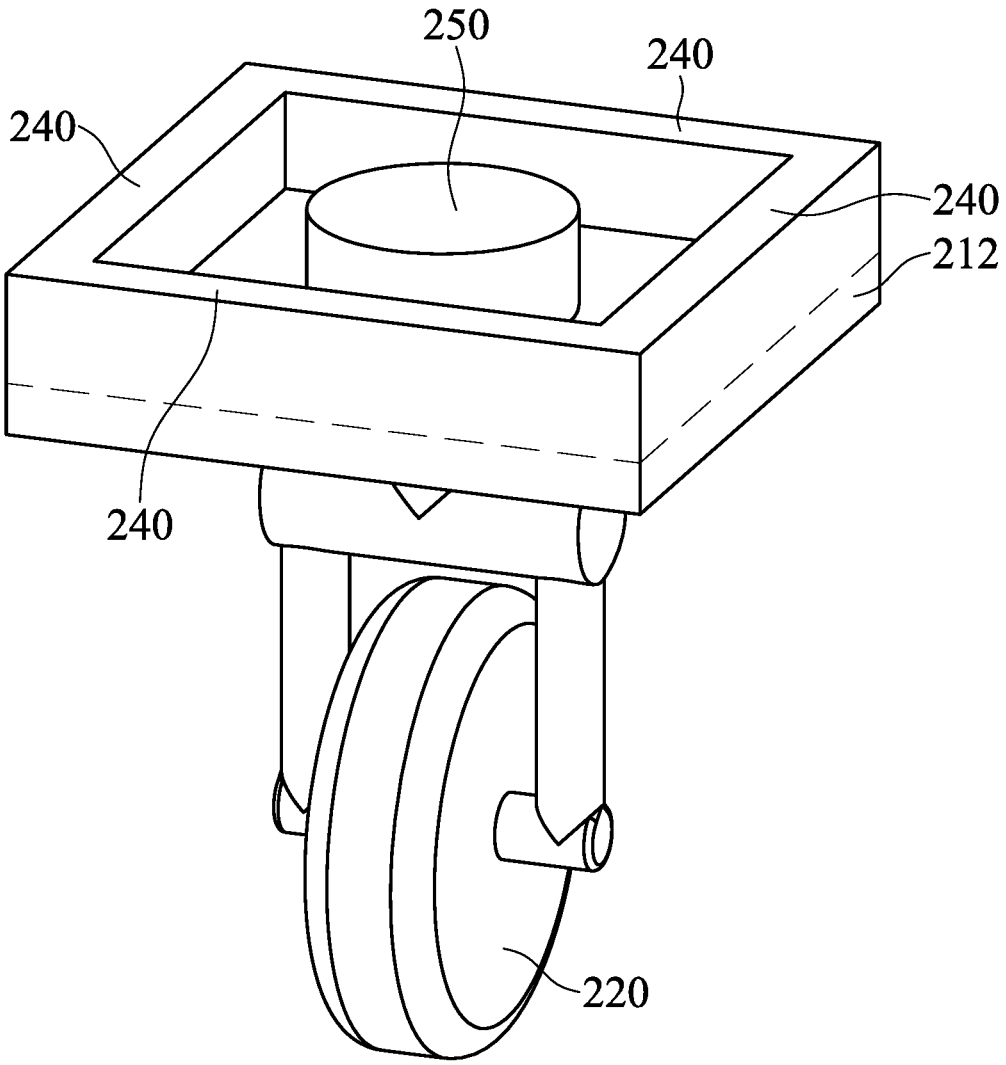
FIG. 3G is a schematic view of a wheel assembly in some embodiments of the present invention.
Figure 3H:
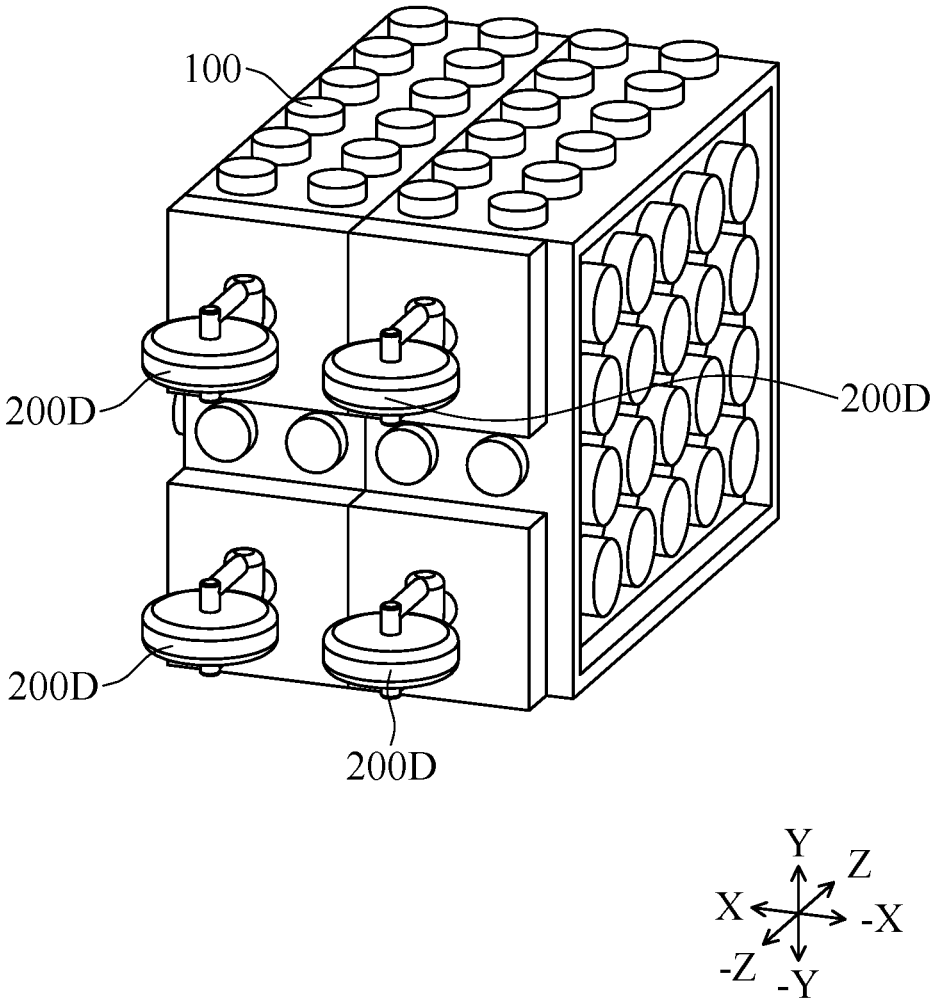
FIG. 3H is a schematic view of the wheel assemblies in FIG. 3G assembled with the case body.

In some embodiments of the present invention, the wheel assembly further includes a wheel tubular projection formed on the base. For example, a wheel tubular projection 250 is formed on the base 212 of a wheel assembly 200D in some embodiments of the present invention, as shown in FIG. 3G. In this configuration, the wheel assembly 200D may be connected to the case body 100 by inserting the top tubular projections 132 into a space between the wheel sidewalls 240 and the wheel tubular projection 250, so the top tubular projections 132 may be closely engaged with the wheel sidewalls 240 and the wheel tubular projection 250, as shown in FIG. 3H.

Figure 4A:
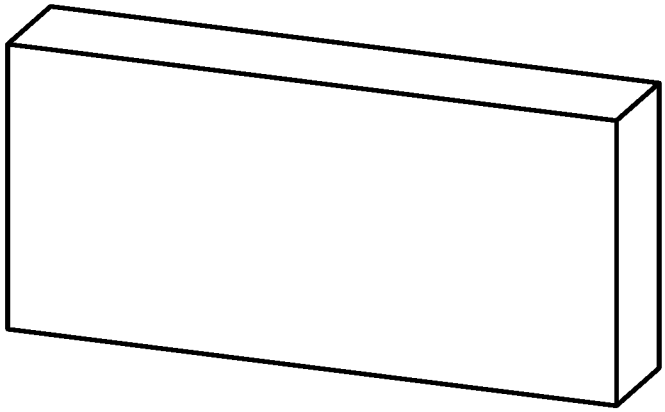
FIGS. 4A-4D are schematic views of some fixing members in some embodiments of the present invention.
Figure 4B:
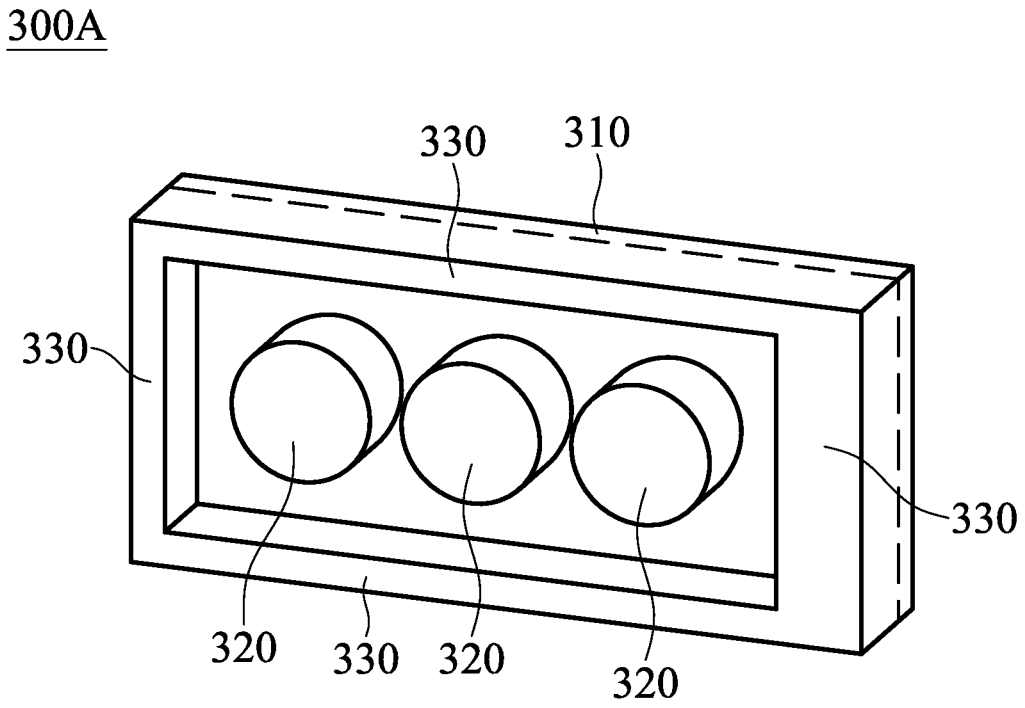

In some embodiments, the front portion 110A and the rear portion 120A may be fastened with each other by providing, for example, a zipper (not shown) between the front portion 110A and the rear portion 120A. In some embodiments, a fixing member may be provided to the suitcase to further fix the front portion 110A and the rear portion 120A, as shown in FIGS. 4A and 4B, which are schematic views of a fixing member 300A shown in different directions in some embodiments of the present invention.

The fixing member 300A includes a main body 310, at least one fixing tubular projection 320 formed on the main body 310, and four fixing sidewalls 330 surrounding the fixing tubular projection 320. The configuration of the fixing tubular projections 320 and the fixing sidewalls 330 may be similar to the bottom tubular projections 140 and the sidewalls 150 to allow other cylindrical projections (such as the side cylindrical projections 130) to be engaged between a space formed between the fixing tubular projections 320 and the fixing sidewalls 330. For example, as shown in FIG. 1, at least one of the side cylindrical projections 130 formed on the front portion 110A and the rear portion 120A may be closely engaged with the fixing tubular projections 320 and the fixing sidewalls 330. As a result, the relative positions of the front portion 110A and the rear portion 120A may be fixed by using the fixing member 300.

Figure 4C:
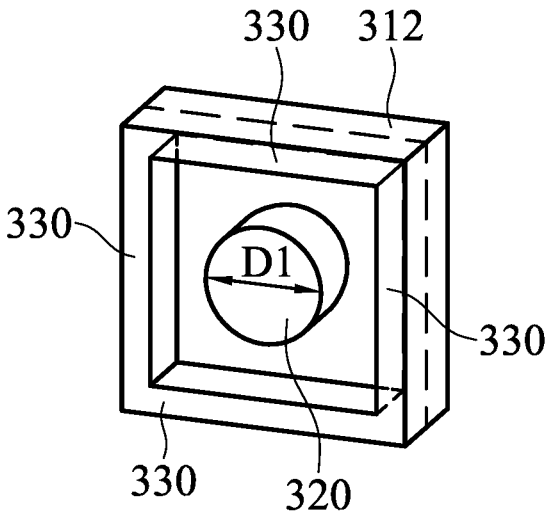
Figure 4D:
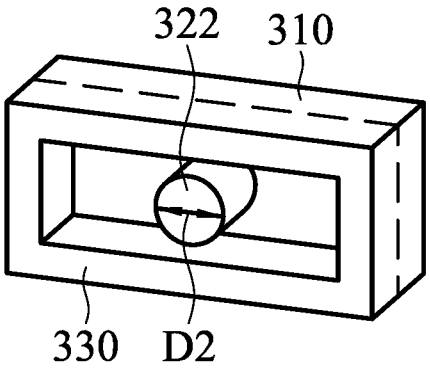
Figure 4E:
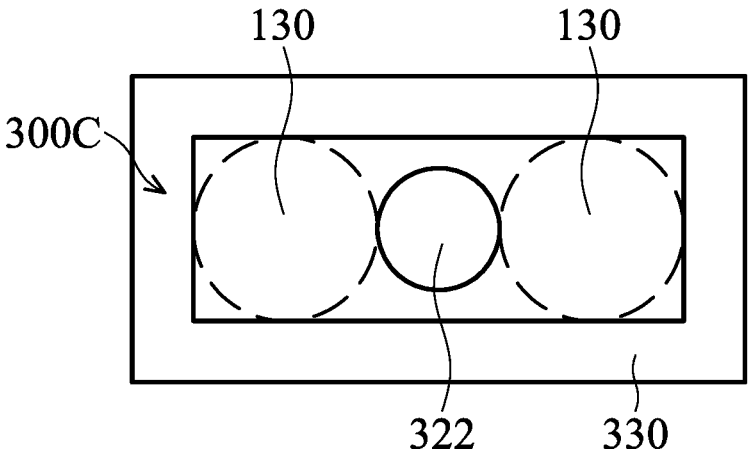
FIG. 4E is a schematic view of a relationship between the fixing member and side cylindrical projections of a suitcase in some embodiments of the present invention.

Although three fixing tubular projections 320 are shown in the previous embodiment, the present invention is not limited thereto. The number of fixing tubular projections 320 may be adjusted based on design requirements. For example, as shown in FIG. 4C, only one fixing tubular projection 320 is provided on the fixing member 300B to reduce the dimension and the cost of the fixing member 300B. In some embodiments, the tubular projection may have a different diameter. For example, the fixing member 300C shown in FIG. 4D only includes four fixing sidewalls 330 formed on the main body 310 and a tubular projection 322 formed thereon. It should be noted that the tubular projection 320 has a diameter D1, and the tubular projection 322 has a diameter D2, wherein D1>D2. The relative positions of the front portion 110A and the rear portion 120A may be also fixed by using the fixing members 300B or 300C. For example, in FIG. 4E, which is a schematic view of a relationship between the fixing member 300C and the side cylindrical projections 130, the side cylindrical projections 130 may be engaged by the tubular projection 322 and the sidewalls 330 (please also see FIG. 2D for comparing the differences). As a result, the dimension of the fixing member may be further reduced to lowering its manufacturing cost.

Figure 5A:
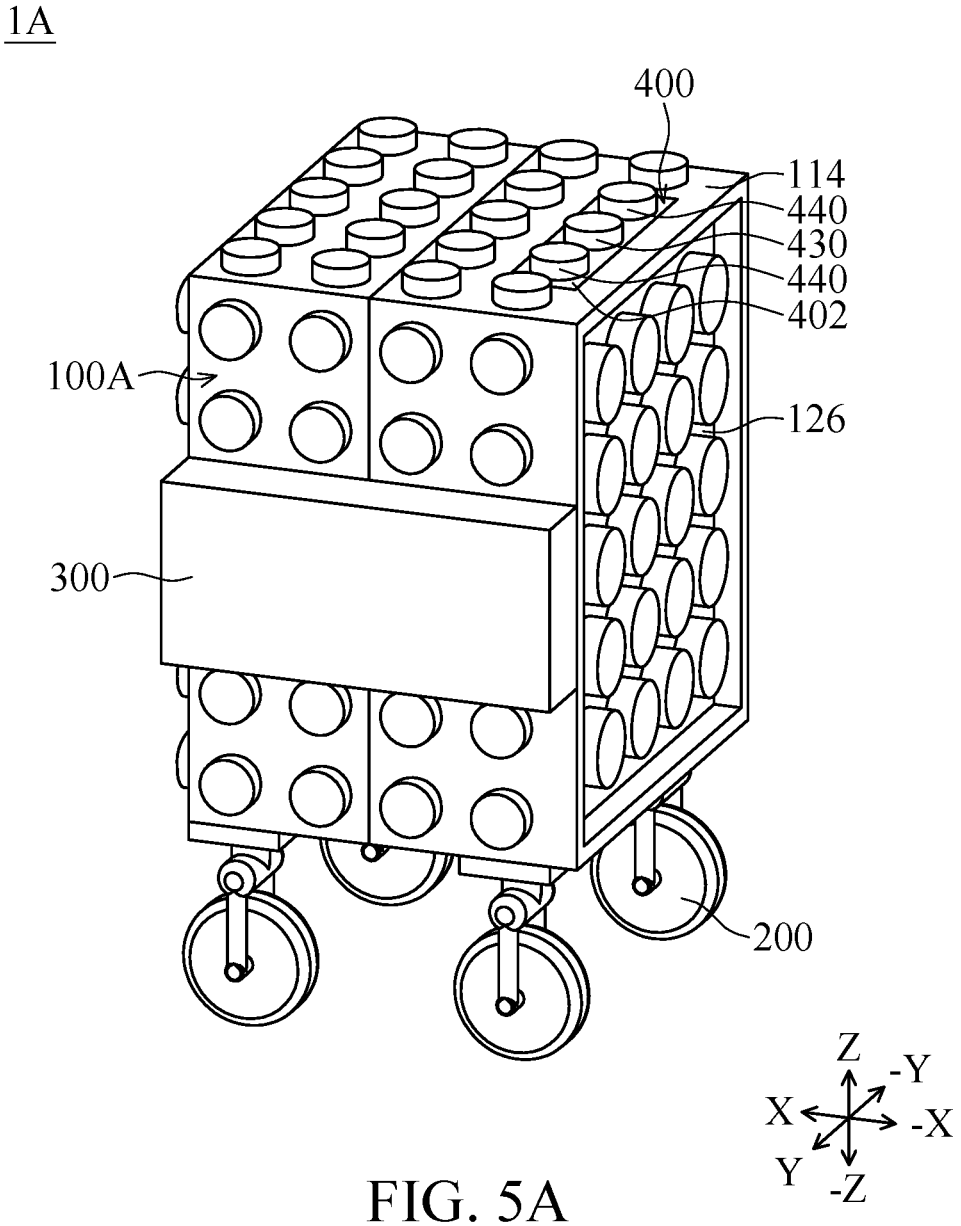
FIGS. 5A-5E are schematic views when a draw bar of the suitcase is taken out in some embodiments of the present invention.
Figure 5B:
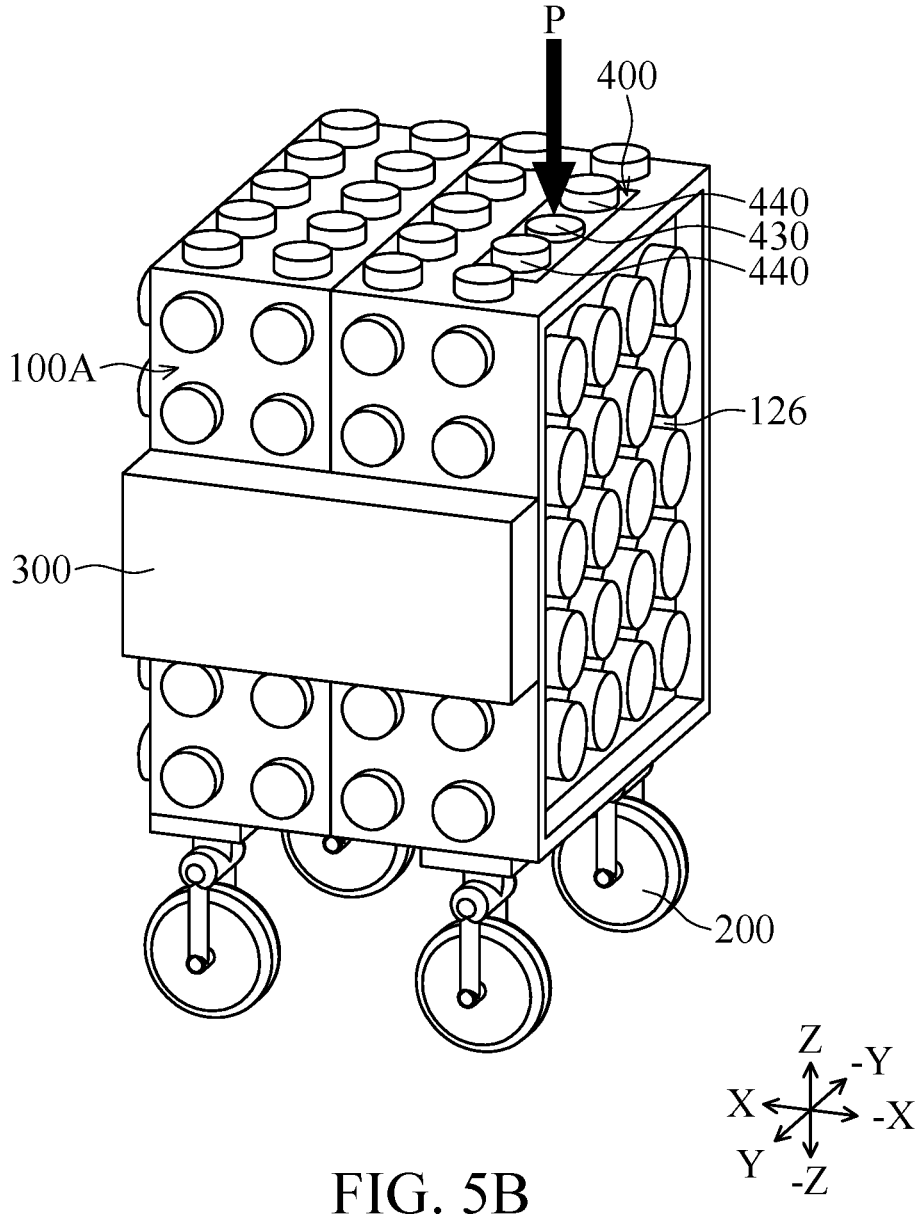
Figure 5C:
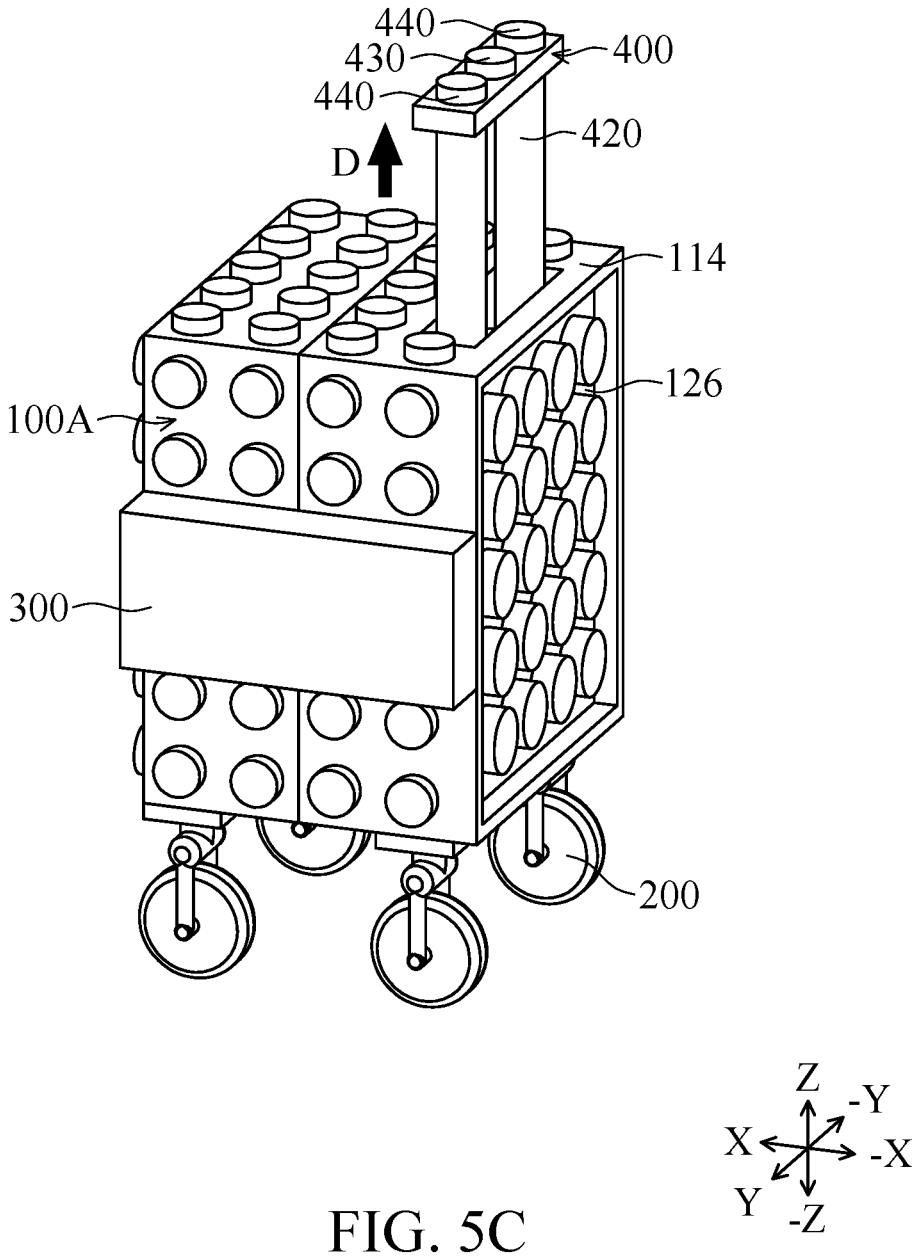
Figure 5D:
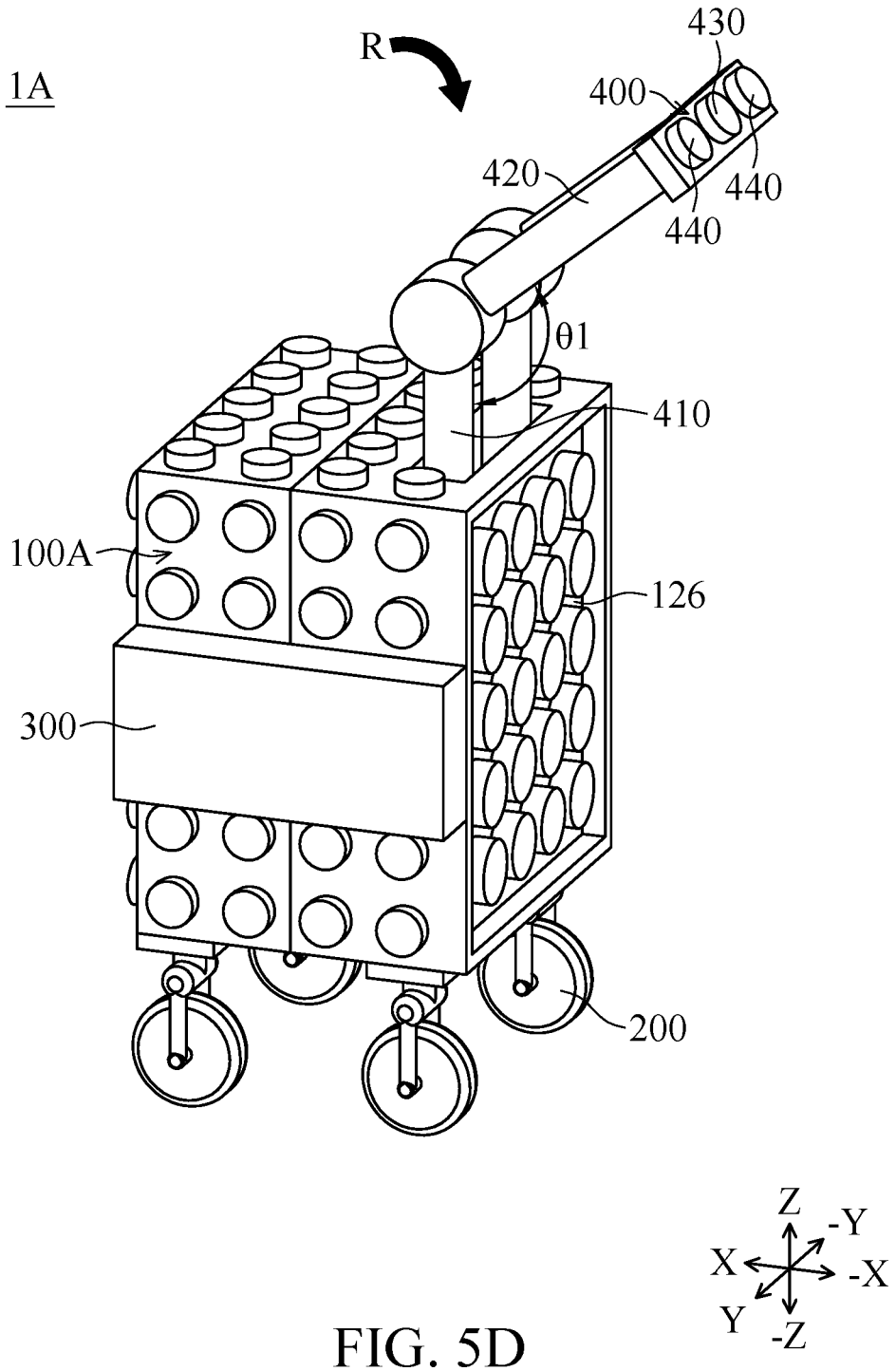
Figure 5E:
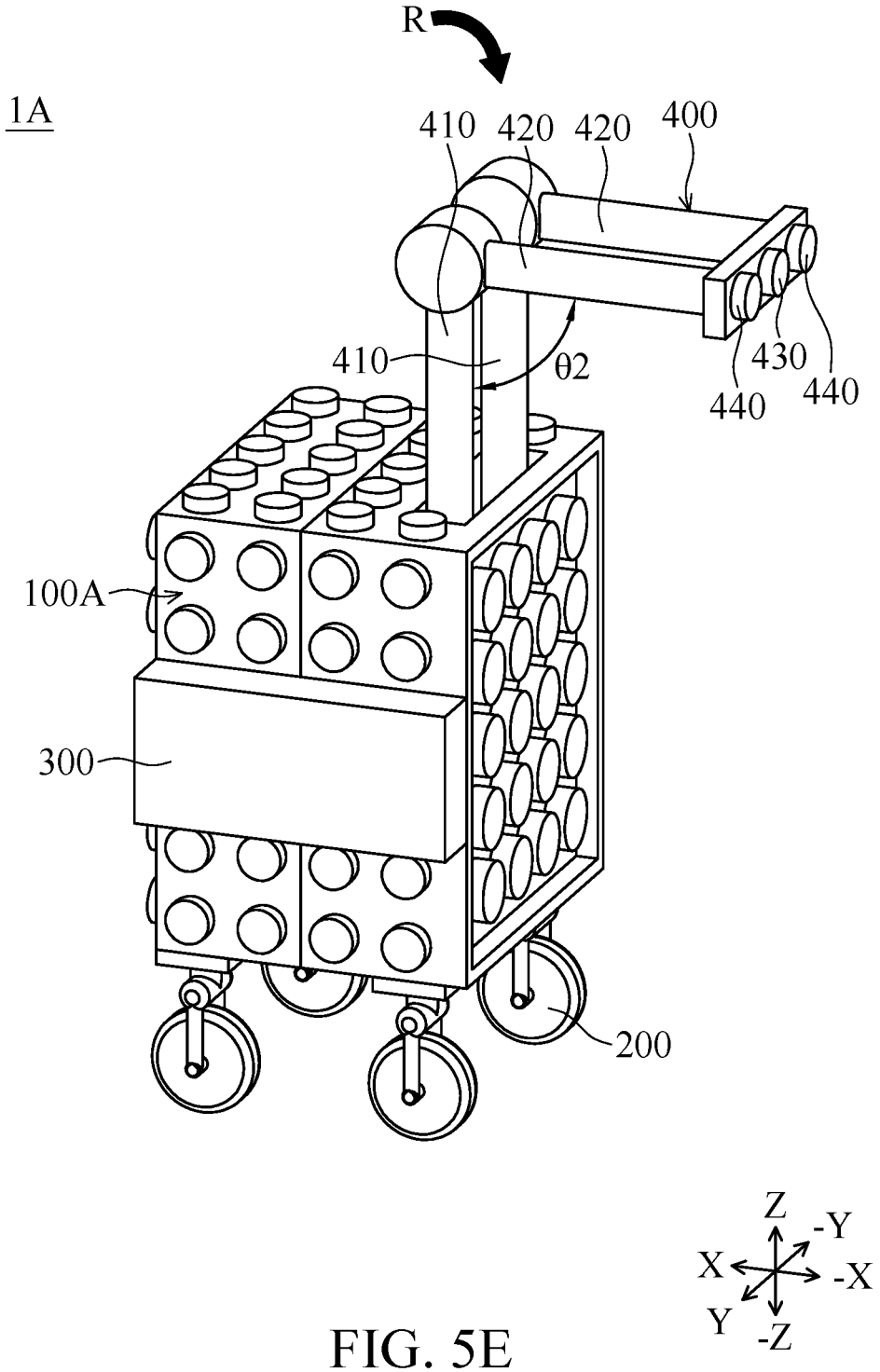

FIGS. 5A-5E are schematic views when the draw bar 400 of the suitcase 1A is taken out. In FIG. 5A, the draw bar 400 is stored in the case body 100, and a surface 402 where the button 430 and the draw bat projections 440 are formed is substantially leveled with the rear top surface 114 of the case body 100A. In FIG. 5B, the button 430 on the draw bar 400 is pressed (as shown by the arrow P) to allow the draw bar 400 to be taken out from the case body 100. In FIG. 5C, the draw bar 400 is taken out from the case body 100 along a direction (as shown by the arrow D) which is substantially perpendicular to the rear top surface 114. In FIG. 5D, the second portion 420 of the draw bar 400 may be rotated relative to the first portion 410 of the draw bar because the first portion 410 and the second portion 420 are articulately connected with each other. In this embodiment, the second portion 420 may be rotated toward the direction (as shown by the arrow R) where the rear surface 126 of the case body 100 faced, and an angle θ1 is formed between the first portion 410 and the second portion 420, wherein the 180 degrees>θ1>90 degrees. In FIG. 5E, the second portion 420 may be fixed after a certain angle θ2 is formed between the first portion 410 and the second portion 420. For example, the angle θ2 may be about 90 degrees to allow the user to push the suitcase 1A in a manner similar to a conventional baggage cart used in airports, which allows the suitcase 1A to be carried more easily.

Figure 6A:
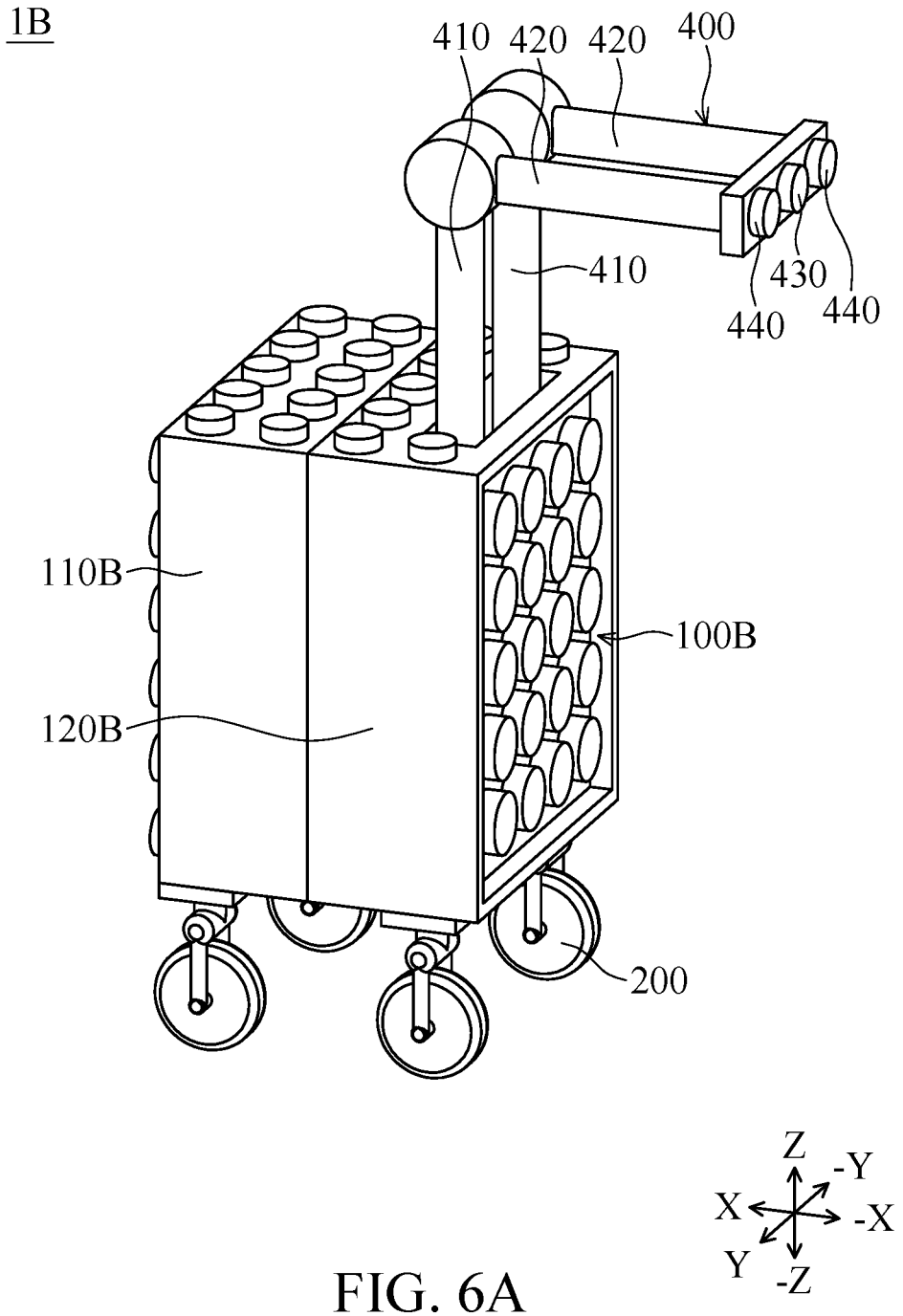
FIG. 6A is a schematic view of a suitcase in some embodiments of the present invention.

Some elements of the suitcase 1A as shown in the previous embodiments may be omitted. For example, in FIG. 6A, the case body 100B of suitcase 1B may not have the side cylindrical protrusion and the fixing member. In this configuration, the front portion 110B and the rear portion 120B of the suitcase 1B may be fixed by, for example, a zipper (not shown) between the front portion 110B and the rear portion 120B.

Figure 6B:
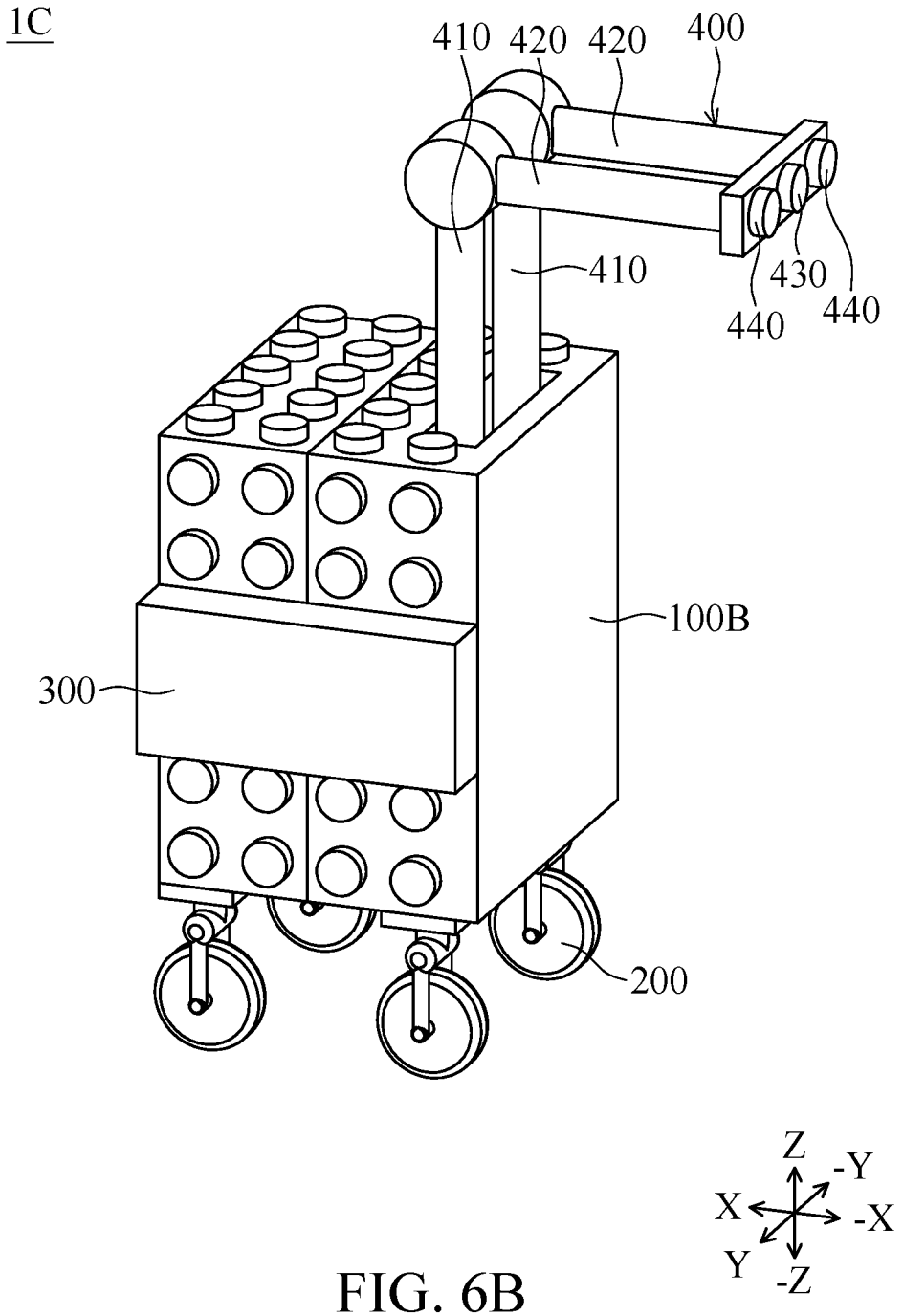
FIGS. 6B and 6C are schematic views of a suitcase in some embodiments of the present invention.
Figure 6C:
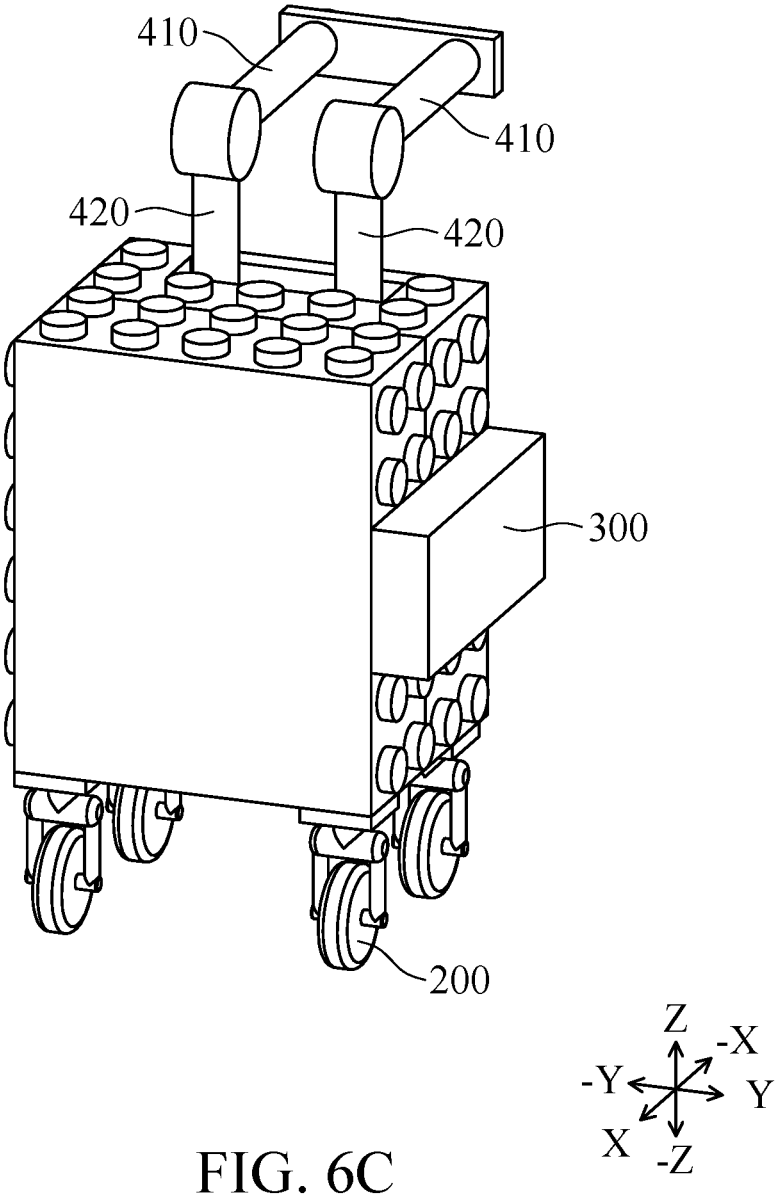
Figure 6D:
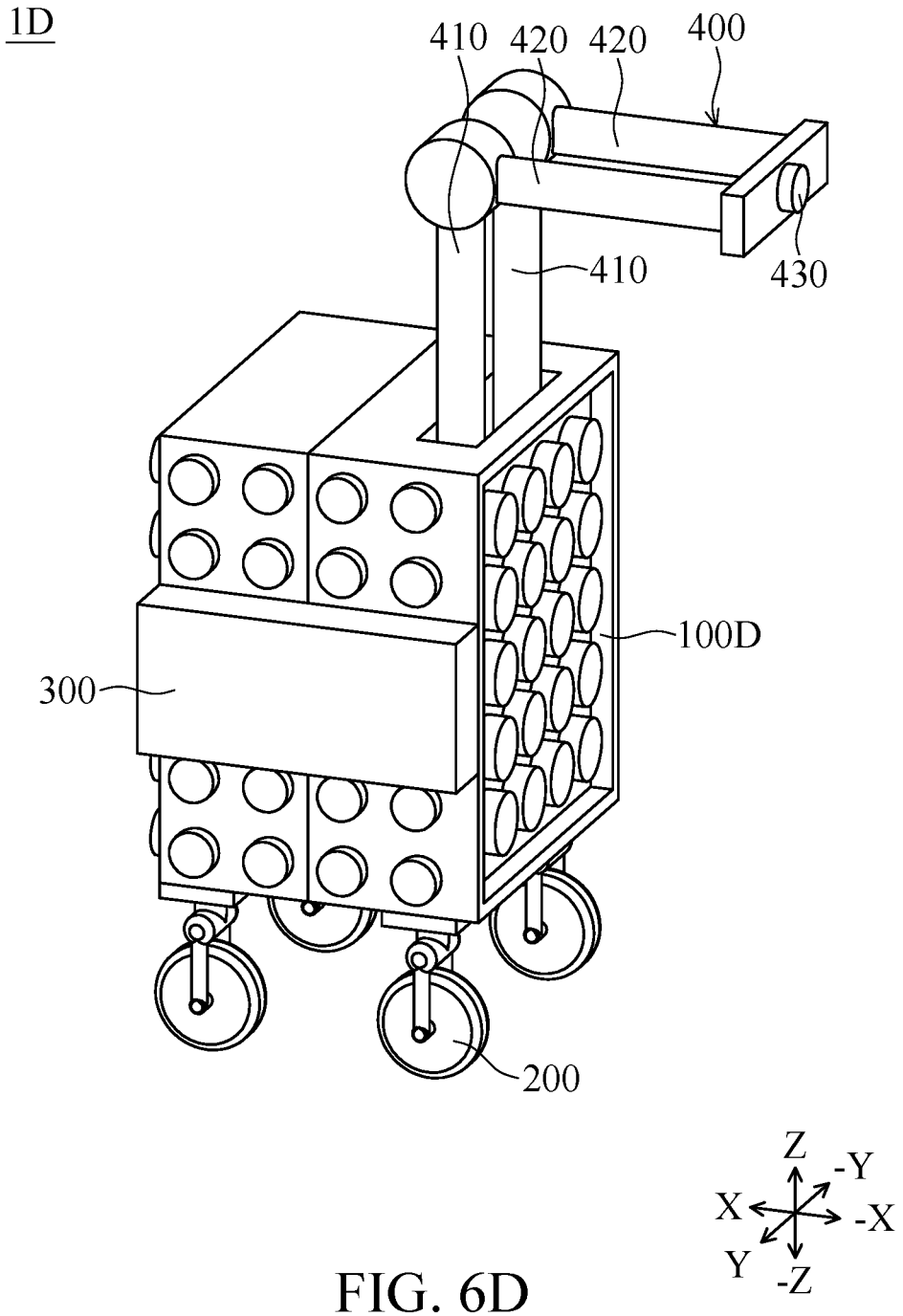
FIG. 6D is a schematic view of a suitcase in some embodiments of the present invention.
Figure 6E:
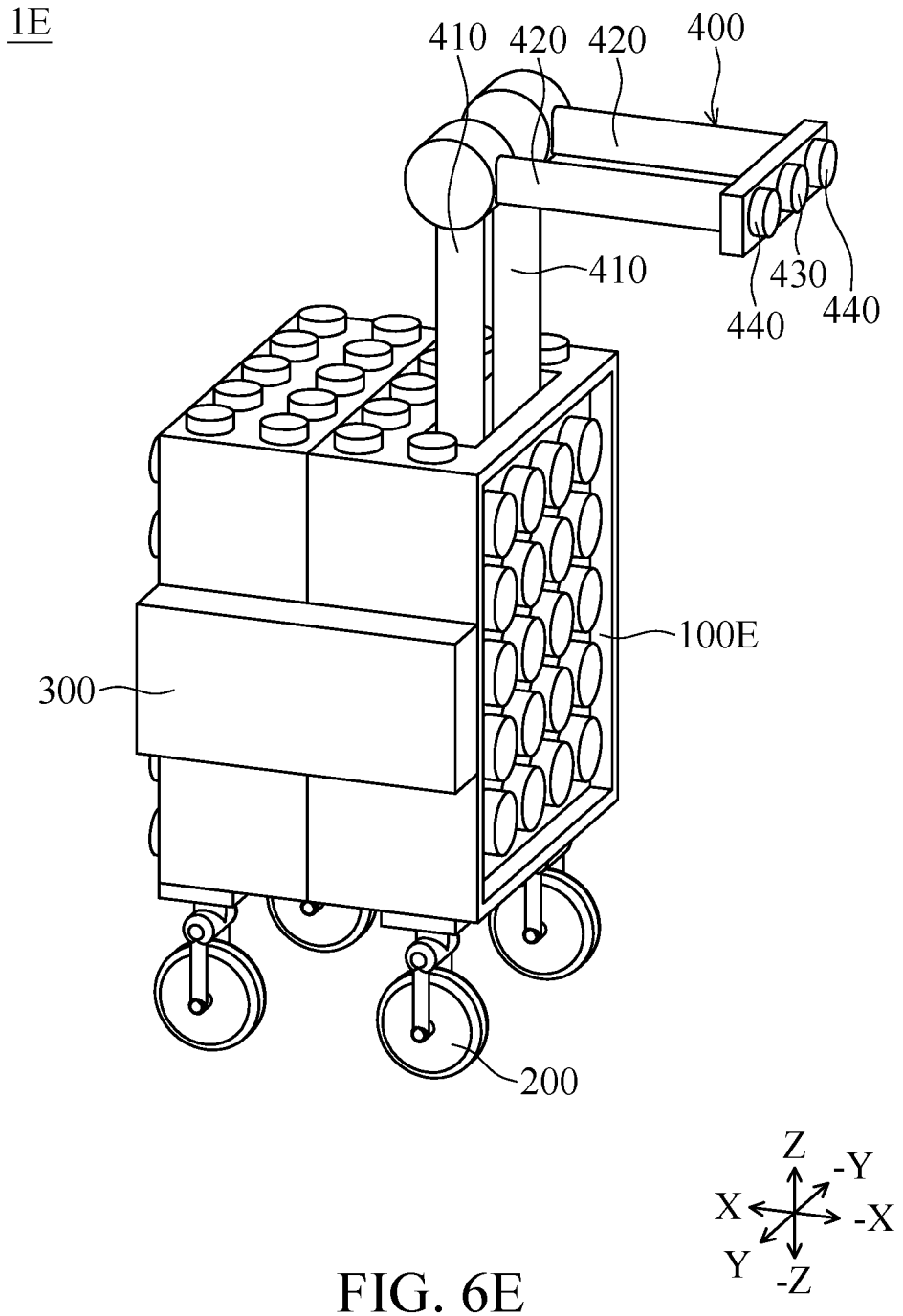
FIG. 6E is a schematic view of a suitcase in some embodiments of the present invention.
Figure 6F:
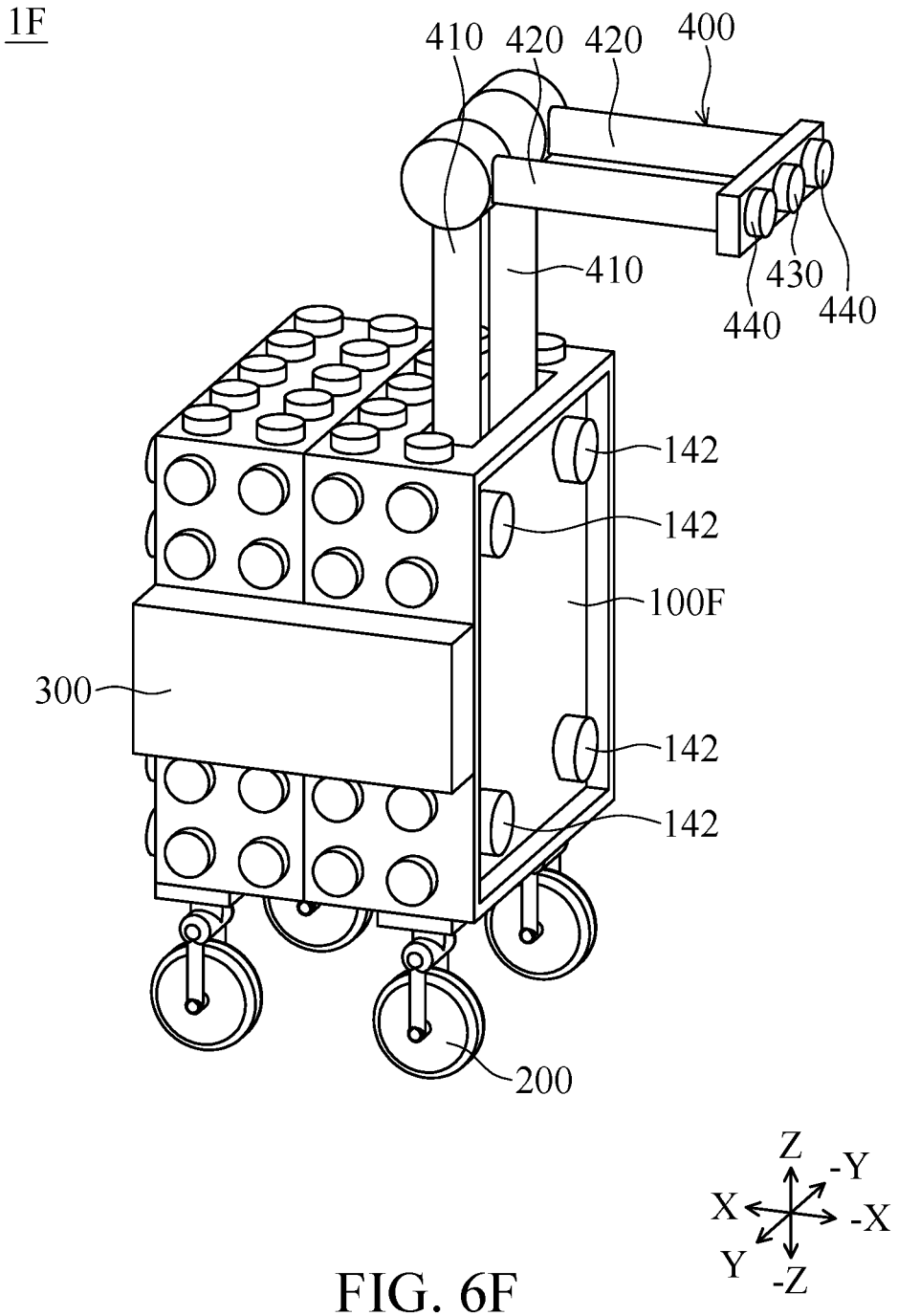
FIGS. 6F and 6G are schematic views of a suitcase in some embodiments of the present invention.
Figure 6G:
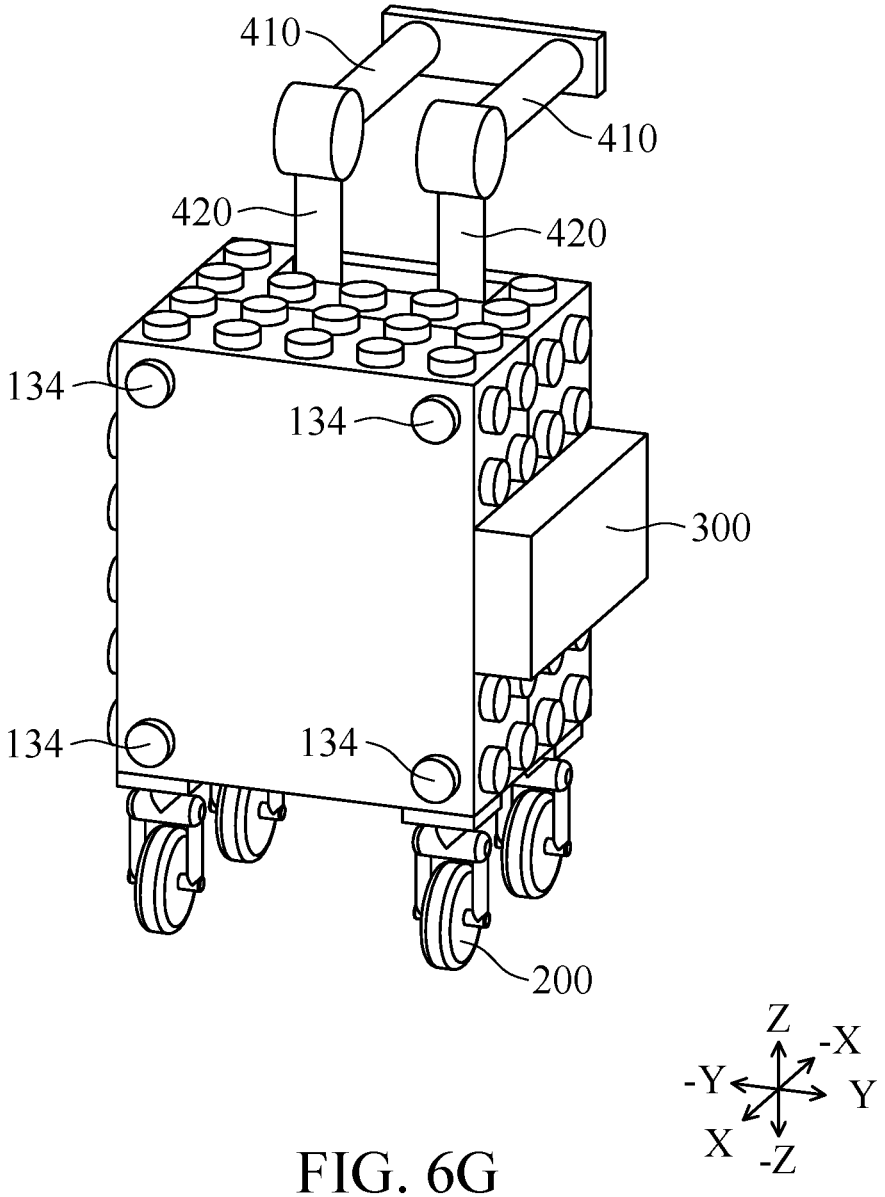
Figure 6H:
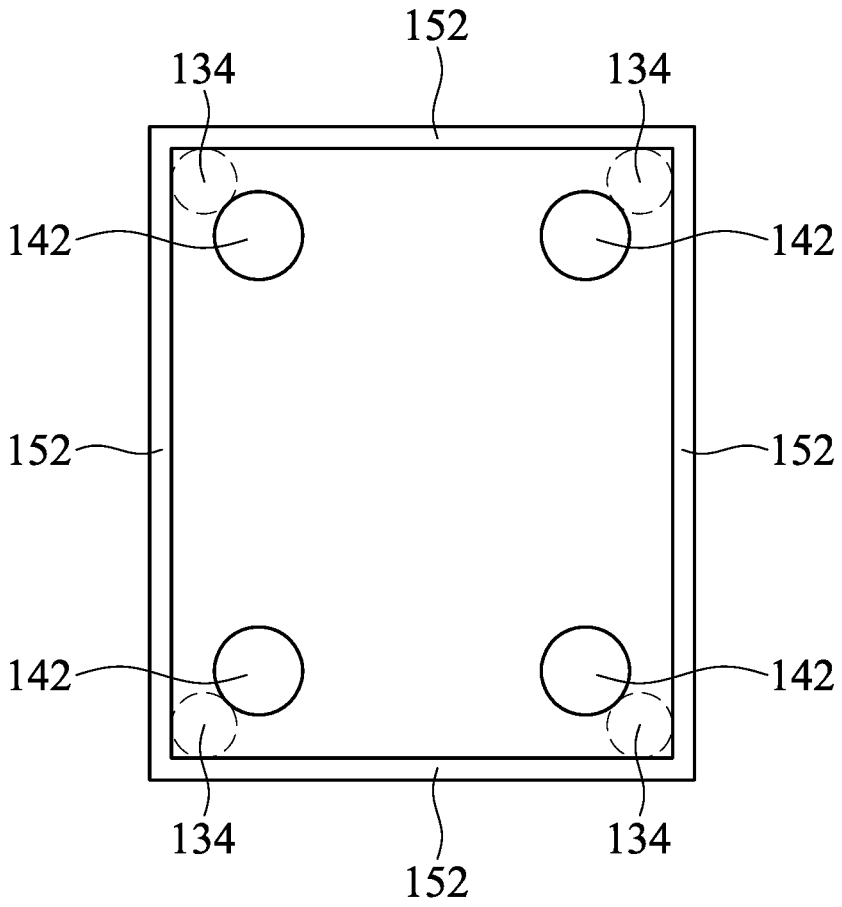
FIG. 6H is a schematic view of a relationship between the front cylindrical projections, the rear tubular projections and the rear sidewalls of a suitcase in some embodiments of the present invention.

Another suitcase 1C is shown in FIGS. 6B and 6C, wherein no front cylindrical projection, rear tubular projection and sidewall are formed on the case body 100C of the suitcase 1C. As a result, the manufacturing process of the suitcase 1C may be simplified. A suitcase 1D is illustrated in FIG. 6D in another embodiment of the present invention, wherein the top cylindrical projections and the draw bar projections are omitted from the case body 100D. As a result, the manufacturing process of the suitcase 1D may be simplified. In FIG. 6E, some of the side cylinder projections 130 on the case body 100E may be omitted, only a portion of the side cylinder projections 130 of the suitcase 1E is left (under the fixing member 300, not shown in FIG. 6E). As a result, the cost of the suitcase 1E may be reduced. In a suitcase 1F shown in FIGS. 6F and 6G, some front cylindrical projections 134 and rear tubular projections 142 are omitted, only some front cylindrical projections 134 and rear tubular projections 142 left on the corners are provided on the case body 100F of the suitcase 1F. FIG. 6H is a schematic view of a relationship between the front cylindrical projections 134, the rear tubular projections 142 and the rear sidewalls 152, wherein the front cylindrical projections 134 are closely engaged by the rear tubular projections 142 and the rear sidewalls 152. This configuration also allows the suitcases 1F to be assembled with each other, and the cost of the suitcase 1F may be reduced as well. Furthermore, the design flexibility may be enhanced to allow the suitcases disclosed in the present invention meeting various requirements by these configurations.

Figure 7A:
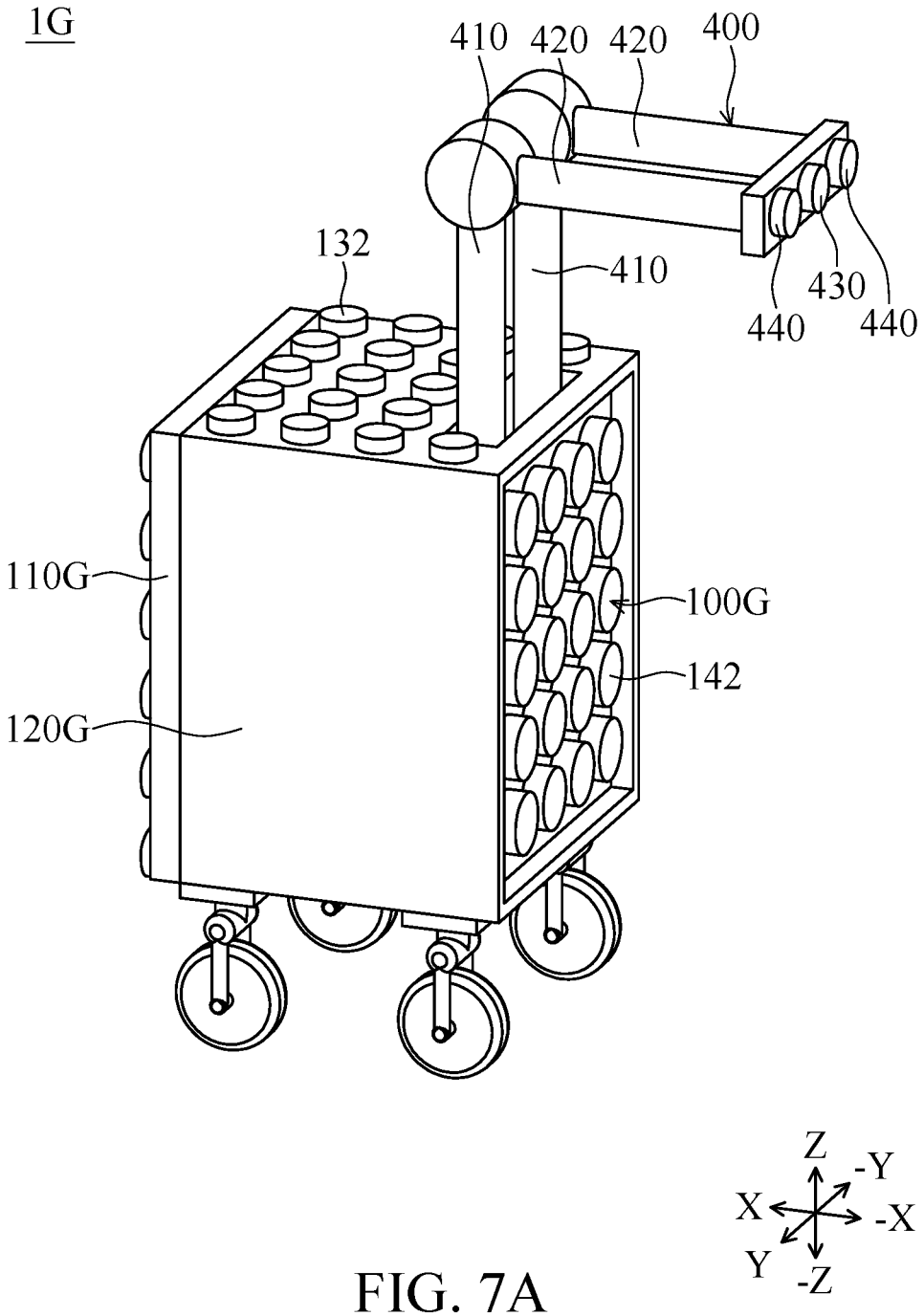
FIGS. 7A and 7B are schematic views of a suitcase in some embodiments of the present invention.
Figure 7B:
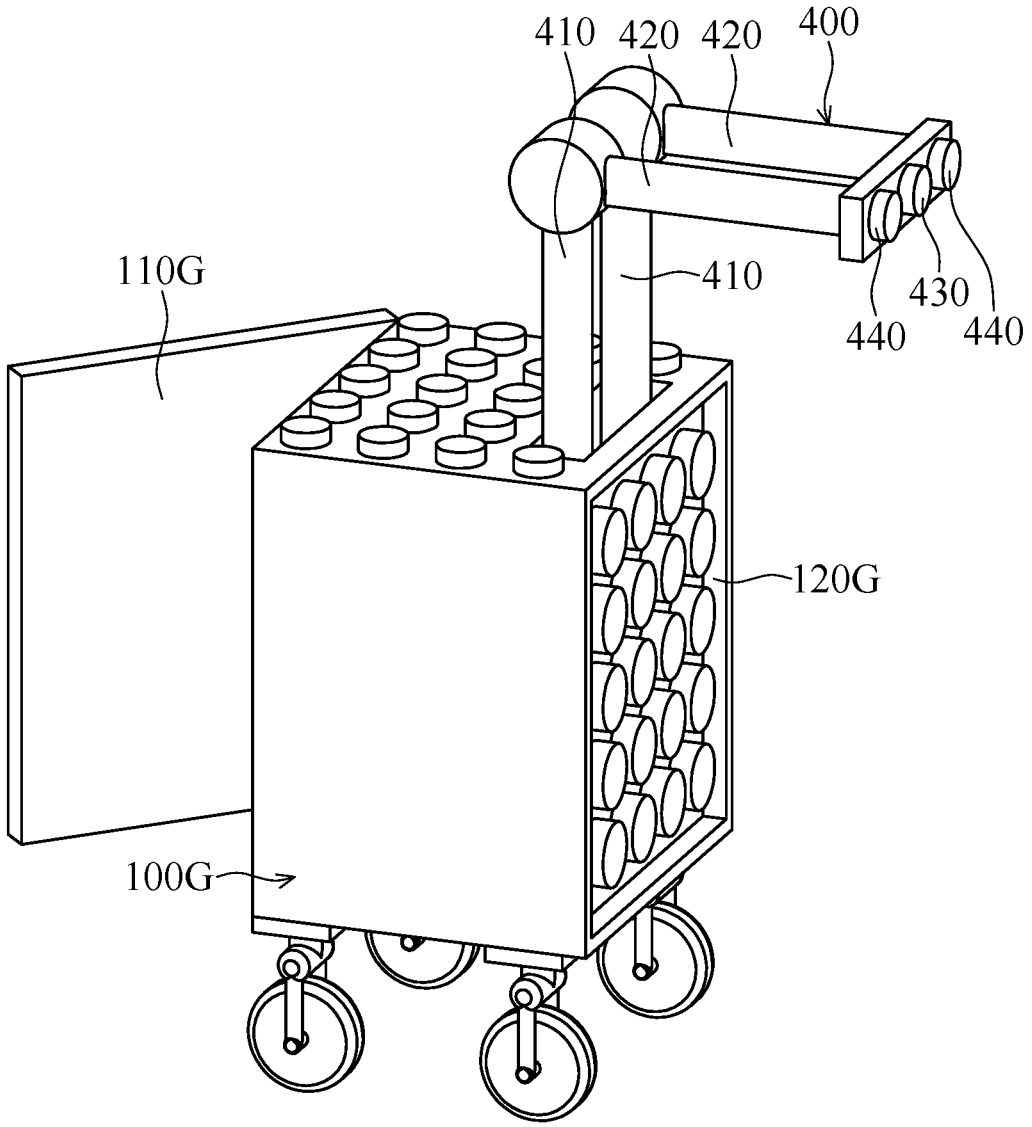
Figure 7B:
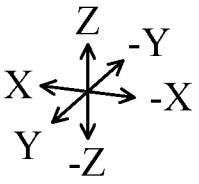

Although the case bodies shown in previous embodiments are illustrated as having a front portion and a rear portion having a recess formed in each portions, the present invention is not limited thereto. For example, referring to FIGS. 7A and 7B, a suitcase 1G having a case body 100G including a front portion 110G and a rear portion 120G is illustrated, wherein the front portion 110G has a plate-like shape, and no recess is formed in the front portion 110G. Furthermore, in this embodiment, the top cylindrical projections 132, the bottom tubular projections 140 (not shown in FIGS. 7A and 7B) and the sidewalls 150 (not shown in FIGS. 7A and 7B) may be formed only on the rear portion 120G rather than on the front portion 110G, and the front portion 110G and the rear portion 120G may be fixed by, for example, a zipper (not shown). As a result, the design flexibility may be increased.

Figure 8:
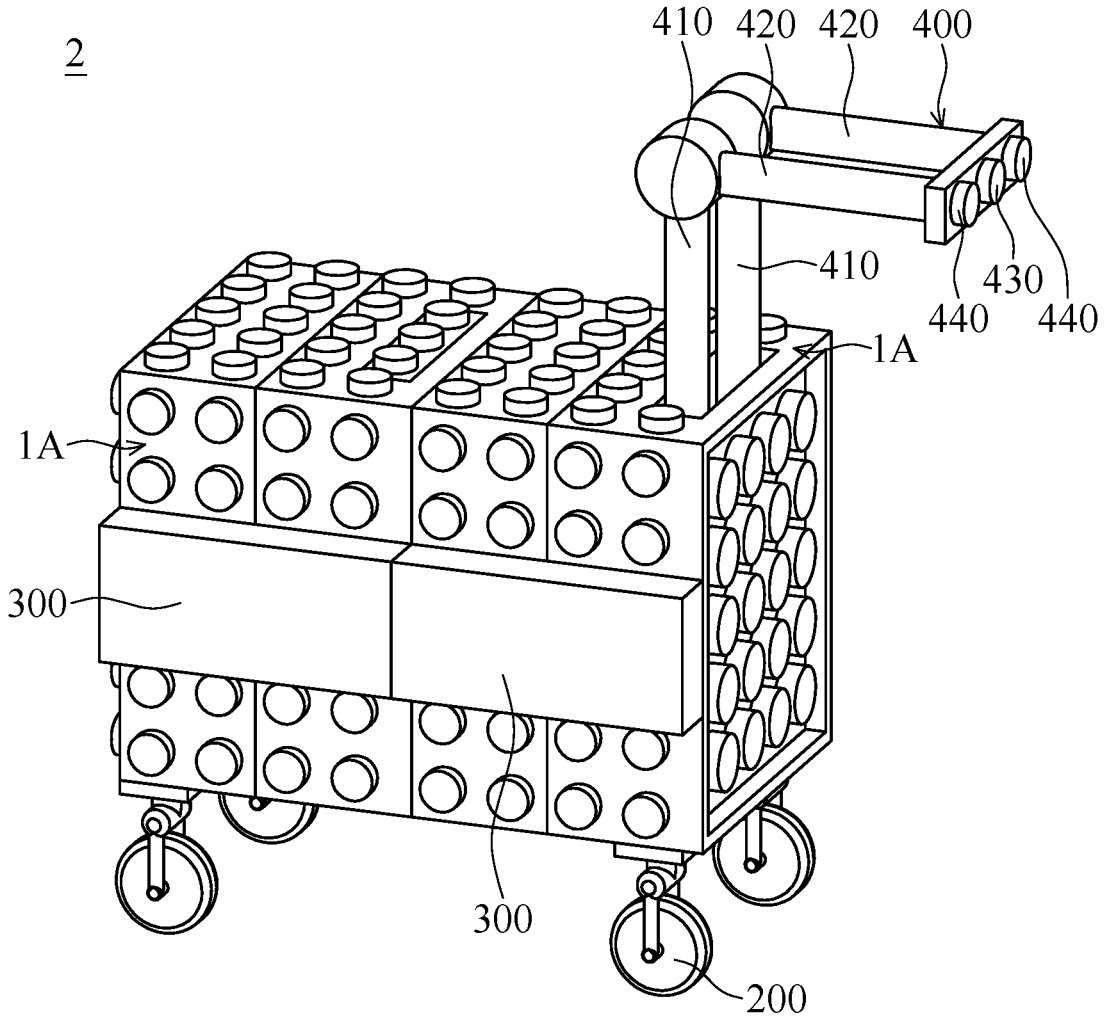
FIG. 8 is a schematic view of a suitcase assembly in some embodiments of the present invention.
Figure 8:
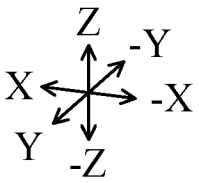

The suitcases disclosed in the aforementioned embodiments may be assembled with each other, such as being assembled as LEGO blocks. For example, referring to FIG. 8, a schematic view of a suitcase assembly 2 in some embodiments of the present invention is shown, wherein two suitcases 1A are assembled with each other, and the front cylindrical projections 132 of one of the case bodies 100A are closely engaged with the rear tubular projections 142 and the rear sidewalls 152 of another case body 100A. It should be noted that some of the wheel assemblies 200 may be omitted. For example, each of the suitcases 1A only has two wheel assemblies 200, which makes a total number of four wheel assemblies 200 included in the suitcase assembly 2.

In some embodiments, each of the draw bars 400 has a first portion 410 directly connected to one of the case bodies 100A and a second portion 420 articulately connected to the first portion 410. As a result, the suitcase assembly 2 may act as a large suitcase, and a user only have to move one suitcase assembly 2 at once instead of moving multiple suitcases 1A separately. Moreover, the second portion 420 may be, for example, substantially perpendicular to the first portion 410 to allow a user push the suitcase assembly 2 in a manner similar to a baggage cart in airports, which allows the suitcase assembly 2 to be carried more easily.

Figure 9:
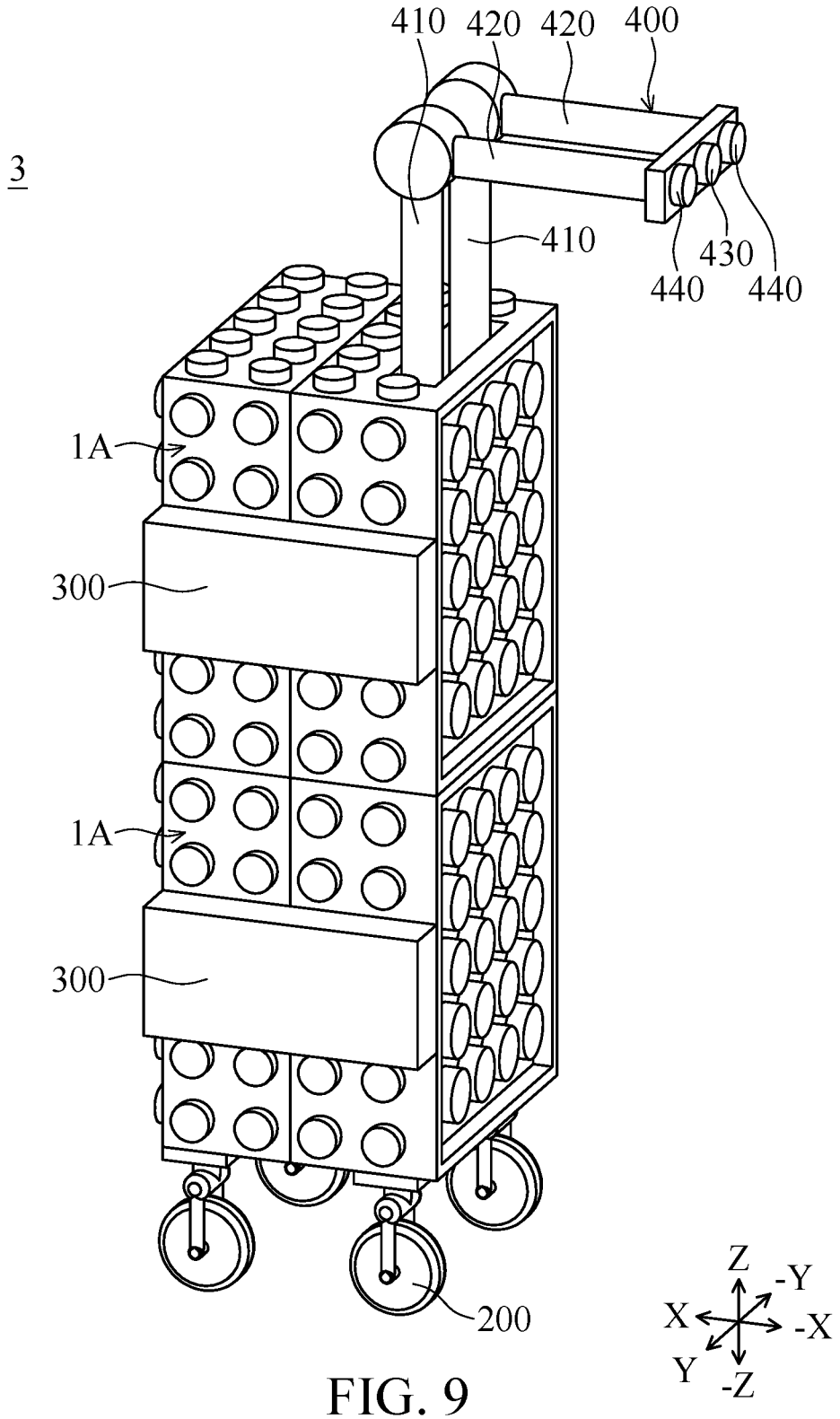
FIG. 9 is a schematic view of a suitcase assembly in some embodiments of the present invention.

FIG. 9 is a suitcase assembly 3 in some embodiments of the present invention. In FIG. 9, two suitcases 1A are assembled with each other, wherein the top cylindrical projections 132 of one of the case bodies 100A are closely engaged with the bottom tubular projections 140 and the sidewalls 150 of another case body 100A. In other words, a suitcase 1A is stacked on and assembled with another suitcase 1A, wherein the wheel assemblies 200 of the suitcase 1A on the top may be taken off, and the suitcase 1A at the bottom still has its own four wheel assemblies 200.

As a result, the suitcase assembly 3 may act as a large suitcase, and a user only has to move one suitcase assembly 3 at once instead of moving multiple suitcases 1A separately. In other embodiments, the top cylindrical projection 132 formed on one of the case bodies 100A is closely engaged with the plurality of bottom tubular projections 140 of another case body 100A.

Figure 10:
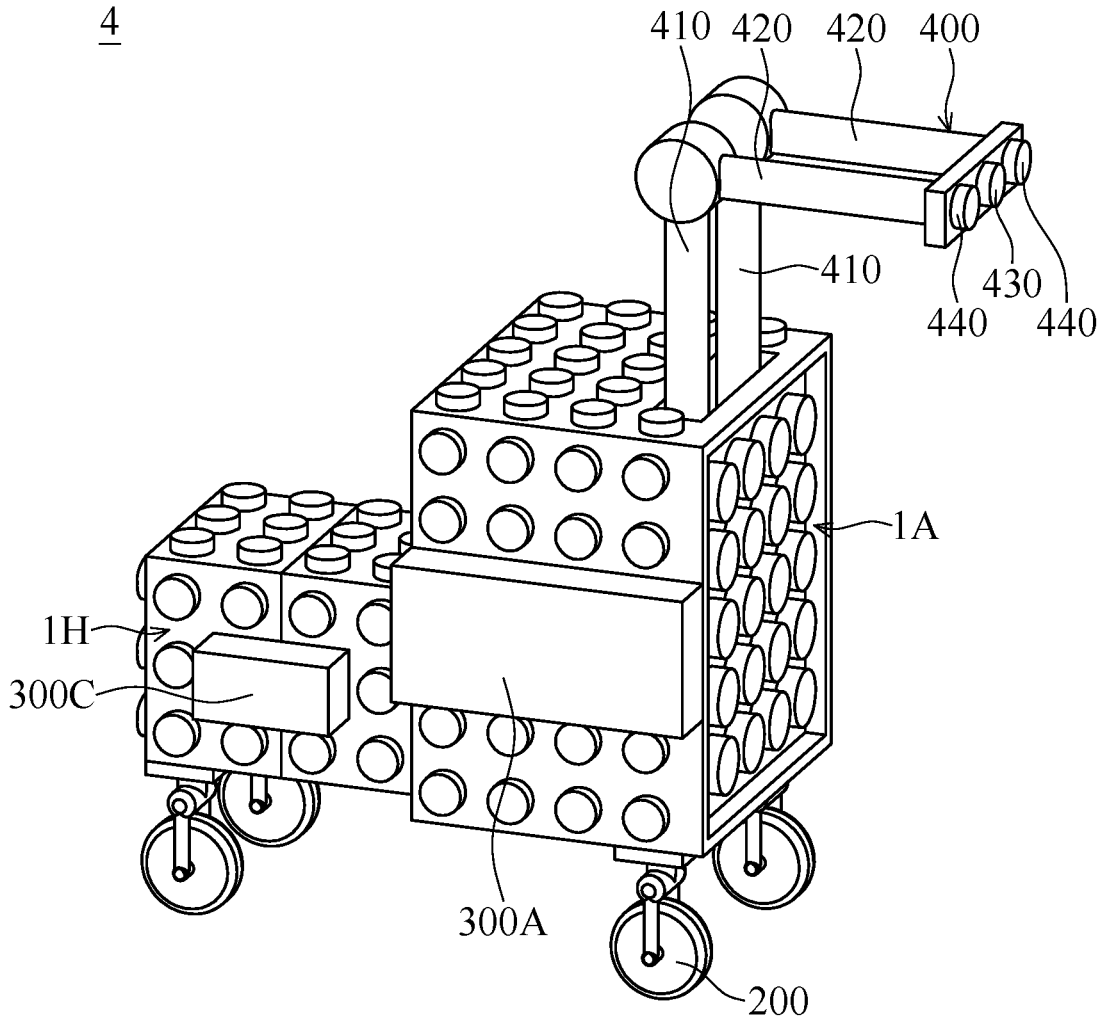
FIG. 10 is a schematic view of a suitcase assembly in some embodiments of the present invention.
Figure 10:
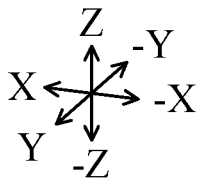

The suitcase assemblies in some embodiments of the present invention may have suitcases with different dimensions, as shown in FIG. 10, which is a schematic view of a suitcase assembly 4 in some embodiments of the present invention. In FIG. 10, a suitcase 1A and a suitcase 1H are assembled with each other, wherein suitcase 1H is smaller than suitcase 1A. This may happen when a parent would like to carry his or her child's suitcase together with his or her own suitcase.

Figure 11:
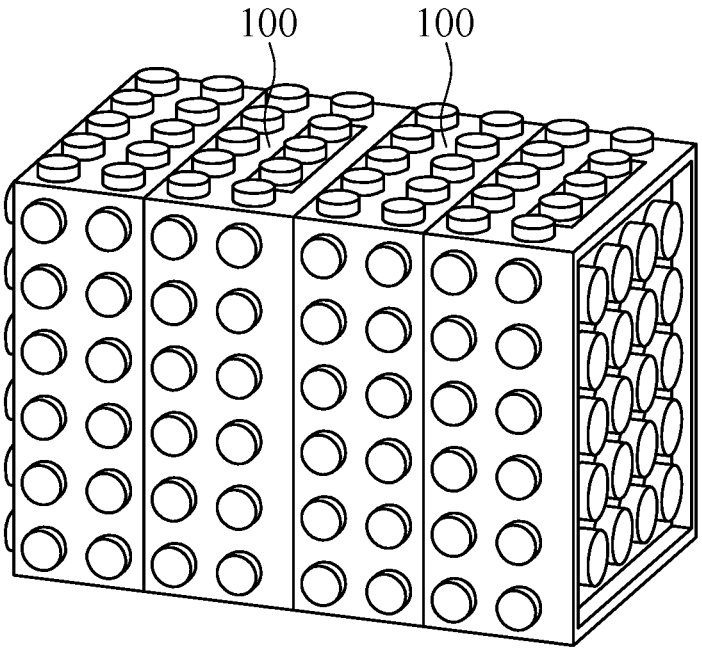
FIG. 11 is a schematic view of two case bodies in some embodiments of the present invention.
Figure 11:
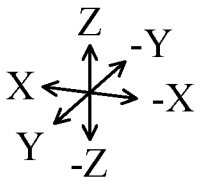

The case body 100 (e.g. 100A, 100B, 100C, 100D, 100E, 100F or 100G, etc) may also act as a decoration. For example, as shown in FIG. 11, the case bodies 100 may be assembled with each other as a decoration, in other words, like LEGO blocks.

In summary, a suitcase and a suitcase assembly formed by the suitcases are provided in the present invention. By providing cylindrical projections, tubular projections and sidewalls on the suitcase, the suitcases may be assembled with each other to be carried together. Furthermore, a draw bar having two portions articulated connected with each other is provided to allow the suitcase or the suitcase assembly to be carried more easily.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A suitcase, comprising:

a case body having a cuboid shape, comprising:

a front portion;

a rear portion connected to the front portion, wherein the front portion and the rear portion are arranged in a first direction;

a plurality of top cylindrical projections on the rear portion that protrude outwardly in a second direction perpendicular from the first direction;

at least one bottom tubular projection on the rear portion that protrudes outwardly in a third direction opposite from the second direction; and four sidewalls surrounding the bottom tubular projection, wherein there is a space between the bottom tubular projection and the sidewalls; and a plurality of wheel assemblies, wherein each of the wheel assemblies comprises a connecting element, and the wheel assemblies are connected to the case body by being closely engaged to the top cylindrical projections or closely engaged in the space by the connecting element.

2. The suitcase as claimed in claim 1, wherein the case body further comprises a plurality of side cylindrical projections formed on a front side surface of the front portion and a rear side surface of the rear portion, the top cylindrical projections are formed on a rear top surface of the rear portion, and the rear top surface faces a different direction than the front side surface and the rear side surface.

3. The suitcase as claimed in claim 2, further comprising a fixing member, comprising:

a main body;

at least one fixing tubular projection formed on the main body; and four fixing sidewalls surrounding the fixing tubular projection, wherein at least one of the side cylindrical projections formed on the front portion and at least one of the side cylindrical projections formed the rear portion are closely engaged with the fixing tubular projection and the fixing sidewalls.

4. The suitcase as claimed in claim 1, wherein each of the wheel assemblies comprises:

a base;

a wheel connected to one side of the base; and a wheel cylindrical projection formed on another side of the base, wherein the wheel cylindrical projection is closely engaged in the space.

5. The suitcase as claimed in claim 1, wherein each of the wheel assemblies comprises:

a base;

a wheel connected to one side of the base; and four wheel sidewalls formed on another side of the base, wherein at least one of the top cylindrical projections is closely engaged with the wheel sidewalls, and at least one of the top cylindrical projections is closely engaged to the top cylindrical projections.

6. The suitcase as claimed in claim 1, further comprising a draw bar having a first end and a second end, wherein the first end is connected to the case body, and the second end is opposite the first end and comprises a button having the same shape as one of the top cylindrical projections.

7. The suitcase as claimed in claim 6, wherein the draw bar further comprises:

a first portion directly connected to the case body; and a second portion articulately connected to the first portion by an articulate connecting portion between the first portion and the second portion.

8. The suitcase as claimed in claim 1, further comprising:

a plurality of front cylindrical projections formed on the front portion and extending in the first direction;

at least one rear tubular projection formed on the rear portion and extending in a fourth direction opposite from the first direction; and four rear sidewalls surrounding the rear tubular projection.

9. The suitcase as claimed in claim 8, wherein each of the front cylindrical projections has the same dimensions as each of the top cylindrical projections, and the rear tubular projection has the same dimensions as the bottom tubular projection.

10. A suitcase assembly, comprising:

at least two case bodies having a cuboid shape and connected with each other, wherein each of the case bodies comprises:

a front portion;

a rear portion connected to the front portion, wherein the front portion and the rear portion are arranged in a first direction;

a plurality of top cylindrical projections on the rear portion that protrude outwardly in a second direction perpendicular from the first direction;

at least one bottom tubular projection on the rear portion and protrudes outwardly in a third direction opposite from the second direction; and four sidewalls surrounding the bottom tubular projection; and a plurality of wheel assemblies, wherein each of the wheel assemblies comprises a connecting element, and the wheel assemblies are connected to one of the case bodies by the connecting element.

11. The suitcase assembly as claimed in claim 10, wherein at least one of the top cylindrical projections formed on one of the case bodies is closely engaged with the bottom tubular projection and at least one of the sidewalls of another case body.

12. The suitcase assembly as claimed in claim 10, wherein at least one of the top cylindrical projections formed on one of the case bodies is closely engaged with a plurality of the bottom tubular projections of another case body.

13. A suitcase assembly, comprising:

at least two case bodies having a cuboid shape and connected with each other in a first direction, wherein each of the case bodies comprises:

a front portion having a front surface;

a rear portion connected to the front portion, wherein the front portion and the rear portion are arranged in the first direction, and the rear portion has a rear surface;

a plurality of front cylindrical projections formed on the front portion and protrude outwardly in the first direction;

at least one rear tubular projection formed on the rear portion, wherein the rear tubular projection protrudes outwardly in a second direction opposite from the first direction; and four sidewalls surrounding the rear tubular projection; and a plurality of wheel assemblies, wherein each of the wheel assemblies comprises a connecting element, a base, and a wheel, the wheel and the connecting element are connected to the base, and the wheel assemblies are connected to the case bodies by the connecting element, wherein at least one of the front cylindrical projection of one of the case bodies is closely engaged with the rear tubular projection and the sidewalls of another case body, and the wheel of each of the wheel assemblies does not overlap the case bodies in the first direction.

14. The suitcase assembly as claimed in claim 13, wherein the two case bodies have different dimensions.

15. The suitcase assembly as claimed in claim 13, further comprising a plurality of draw bars, wherein each of the draw bars has a first portion directly connected to one of the case bodies and a second portion articulately connected to the first portion by an articulate connecting portion between the first portion and the second portion.

* * * * *